US011790850B2

(12) United States Patent
Huangfu et al.

(10) Patent No.: US 11,790,850 B2
(45) Date of Patent: Oct. 17, 2023

(54) PIXEL DRIVING CIRCUIT AND PIXEL DRIVING METHOD THEREFOR, DISPLAY PANEL, AND DISPLAY APPARATUS

(71) Applicant: BOE TECHNOLOGY GROUP CO., LTD., Beijing (CN)

(72) Inventors: Lujiang Huangfu, Beijing (CN); Li Wang, Beijing (CN); Can Zheng, Beijing (CN); Libin Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/791,965

(22) PCT Filed: May 17, 2021

(86) PCT No.: PCT/CN2021/094187

§ 371 (c)(1),
(2) Date: Jul. 11, 2022

(87) PCT Pub. No.: WO2021/249127

PCT Pub. Date: Dec. 16, 2021

(65) Prior Publication Data

US 2023/0042603 A1 Feb. 9, 2023

(30) Foreign Application Priority Data

Jun. 8, 2020 (CN) ..... 202010514385.9

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01);
(Continued)

(58) Field of Classification Search
CPC ..... G09G 2300/0819; G09G 3/3233; G09G 2300/0842
See application file for complete search history.

(56) References Cited

U.S. PATENT DOCUMENTS 7,154,454 B2 12/2006 Okabe et al.
8,803,770 B2 8/2014 Jeong et al.
(Continued)

FOREIGN PATENT DOCUMENTS

CN 205920745 U 2/2017
CN 106531076 A 3/2017
(Continued)

OTHER PUBLICATIONS

PCT International Search Report, dated Jul. 27, 2021, and Written Opinion, dated Jul. 26, 2021, (w/ English translations) for corresponding PCT Application No. PCT/CN2021/094187, 18 pages.
(Continued)

*Primary Examiner* — Van N Chow
(74) *Attorney, Agent, or Firm* — Dority & Manning, P.A.

(57) ABSTRACT

A pixel driving circuit includes a reset sub-circuit, a compensation sub-circuit, a light-emitting control sub-circuit and a driving sub-circuit. The reset sub-circuit is configured to transmit an initialization signal received from an initialization signal terminal to the light-emitting control sub-circuit. The light-emitting control sub-circuit is configured to transmit the initialization signal to the first node. The compensation sub-circuit is configured to transmit the initialization signal from the first node to a second node so as to reset a voltage of the second node. The driving sub-circuit is configured to open a conductive path from a first voltage signal terminal to the initialization signal terminal during a process of resetting the voltage of the second node.

20 Claims, 10 Drawing Sheets

(52) U.S. Cl.
CPC ..... *G09G 2310/0286* (2013.01); *G09G 2310/061* (2013.01); *G09G 2310/08* (2013.01); *G09G 2320/0233* (2013.01); *G09G 2320/0247* (2013.01)

(56) References Cited

U.S. PATENT DOCUMENTS

| | | | | |
|---|---|---|---|---|
| 9,293,087 | B2 | 3/2016 | Lee et al. | |
| 10,339,855 | B2 | 7/2019 | Lin et al. | |
| 11,386,838 | B2 * | 7/2022 | Gao | G09G 3/3233 |
| 2016/0012780 | A1 | 1/2016 | Lee et al. | |
| 2016/0267843 | A1 | 9/2016 | Wang et al. | |
| 2018/0130411 | A1 | 5/2018 | Zhou et al. | |
| 2018/0166025 | A1 | 6/2018 | Zhou et al. | |
| 2019/0172395 | A1 * | 6/2019 | Yuan | G09G 3/3291 |
| 2019/0189053 | A1 | 6/2019 | Kim et al. | |
| 2020/0286425 | A1 * | 9/2020 | Lai | G09G 3/3225 |
| 2021/0312861 | A1 | 10/2021 | Wang et al. | |
| 2021/0327347 | A1 | 10/2021 | Xu | |
| 2021/0366383 | A1 | 11/2021 | Ma | |
| 2021/0407401 | A1 * | 12/2021 | Chen | G09G 3/3233 |
| 2022/0406243 | A1 | 12/2022 | Cong et al. | |

FOREIGN PATENT DOCUMENTS

| | | | |
|---|---|---|---|
| CN | 108806601 | A | 11/2018 |
| CN | 109785797 | A | 5/2019 |
| CN | 110675829 | A | 1/2020 |
| CN | 110767163 | A | 2/2020 |

OTHER PUBLICATIONS

Chinese First Office Action (w/ English translation) for corresponding Chinese Application No. 202010514385.9, dated May 10, 2022, 32 pages.

Chinese Notification to Grant Patent Right for Invention (w/ English translation) for corresponding Chinese Application No. 202010514385.9, dated Oct. 19, 2022, 7 pages.

Fossum et al., "Anomalous Leakage Current in LPCVD Polysilicon MOSFET's", IEEE Transactions on Electron Devices, vol. ED-32, No. 9, Sep. 1985, pp. 1878-1884.

Huang-Fu et al., "LTPS-TFT threshold voltage compensation pixel circuit for AMOLED", (w/ English translation), Chinese Journal of Liquid Crystals and Displays, vol. 32, No. 8, Aug. 2017, 21 pages.

Shur et al., "Analytical models for amorphous-silicon and polysilicon thin-film transistors for high-definition-display technology", Journal of the SID, vol. 3, No. 4, 1995, pp. 223-236.

* cited by examiner

PIXEL DRIVING CIRCUIT AND PIXEL DRIVING METHOD THEREFOR, DISPLAY PANEL, AND DISPLAY APPARATUS

CROSS-REFERENCE TO RELATED APPLICATIONS

This application is a national phase entry under 35 USC 371 of International Patent Application No. PCT/CN2021/094187 filed on May 17, 2021, which claims priority to Chinese Patent Application No. 202010514385.9, filed on Jun. 8, 2020, which are incorporated herein by reference in their entirety.

TECHNICAL FIELD

The present disclosure relates to the field of display technologies, and in particular, to a pixel driving circuit and a driving method therefor, a display panel and a display apparatus.

BACKGROUND

At present, organic light-emitting diode (OLED) display apparatuses have been widely used due to characteristics thereof such as self-luminescence, quick response, wide viewing angle, being capable of being manufactured on flexible substrates. The OLED display apparatus includes a plurality of sub-pixels. Each sub-pixel includes a pixel driving circuit and a light-emitting device. The light-emitting device is driven to emit light by the pixel driving circuit, thereby realizing display.

SUMMARY

In one aspect, a pixel driving circuit is provided. The pixel driving circuit includes a reset sub-circuit, a compensation sub-circuit, a light-emitting control sub-circuit and a driving sub-circuit. The reset sub-circuit is coupled to the light-emitting control sub-circuit, a scanning timing signal terminal and an initialization signal terminal. The light-emitting control sub-circuit is further coupled to a first node and a first light-emitting timing signal terminal. The compensation sub-circuit is coupled to the first node, a second node and the scanning timing signal terminal. The driving sub-circuit is coupled to the first node, the second node, a first voltage signal terminal and a second light-emitting timing signal terminal.

The reset sub-circuit is configured to transmit an initialization signal received from the initialization signal terminal to the light-emitting control sub-circuit in response to a scanning timing signal received from the scanning timing signal terminal. The light-emitting control sub-circuit is configured to transmit the initialization signal to the first node in response to a first light-emitting timing signal received from the first light-emitting timing signal terminal. The compensation sub-circuit is configured to transmit the initialization signal from the first node to the second node under control of the scanning timing signal, so as to reset a voltage of the second node.

The driving sub-circuit is configured to open a conductive path from the first voltage signal terminal to the initialization signal terminal in response to a second light-emitting timing signal received from the second light-emitting timing signal terminal during a process of resetting the voltage of the second node.

In some embodiments, the reset sub-circuit includes a first transistor. A control electrode of the first transistor is coupled to the scanning timing signal terminal, a first electrode of the first transistor is coupled to the initialization signal terminal, and a second electrode of the first transistor is coupled to the light-emitting control sub-circuit. The light-emitting control sub-circuit includes a second transistor. A control electrode of the second transistor is coupled to the first light-emitting timing signal terminal, a first electrode of the second transistor is coupled to the first node, and a second electrode of the second transistor is coupled to the second electrode of the first transistor The compensation sub-circuit includes a third transistor. A control electrode of the third transistor is coupled to the scanning timing signal terminal, a first electrode of the third transistor is coupled to the first node, and a second electrode of the third transistor is coupled to the second node.

In some embodiments, the driving sub-circuit includes a fourth transistor and a fifth transistor. A control electrode of the fourth transistor is coupled to the second node, a first electrode of the fourth transistor is coupled to the first voltage signal terminal, and a second electrode of the fourth transistor is coupled to a first electrode of the fifth transistor. A control electrode of the fifth transistor is coupled to the second light-emitting timing signal terminal, and a second electrode of the fifth transistor is coupled to the first node.

In some embodiments, the driving sub-circuit includes a fourth transistor and a fifth transistor. A control electrode of the fourth transistor is coupled to the second node, a first electrode of the fourth transistor is coupled to a second electrode of the fifth transistor, and a second electrode of the fourth transistor is coupled to the first node. A control electrode of the fifth transistor is coupled to the second light-emitting timing signal terminal, and a first electrode of the fifth transistor is coupled to the first voltage signal terminal.

In some embodiments, the pixel driving circuit further includes: a storage sub-circuit and a data writing sub-circuit. The storage sub-circuit is coupled to the second node and a third node. The storage sub-circuit is configured to be charged due to action of voltages of the second node and the third node, changing a voltage of the second node according to a voltage of the third node, and maintain the voltage of the second node. The data writing sub-circuit is coupled to the third node, an input control signal terminal and a data signal terminal. The data writing sub-circuit is configured to transmit a data signal received from the data signal terminal to the third node in response to an input control signal received from the input control signal terminal.

In some embodiments, the storage sub-circuit includes a first capacitor. A first end of the first capacitor is coupled to the third node, and a second end of the first capacitor is coupled to the second node.

The data writing sub-circuit includes a sixth transistor. A control electrode of the sixth transistor is coupled to the input control signal terminal, a first electrode of the sixth transistor is coupled to the data signal terminal, and a second electrode of the sixth transistor is coupled to the third node.

In some embodiments, the input control signal terminal and the second light-emitting timing signal terminal are configured to transmit the same signal. The data writing sub-circuit is further coupled to the scanning timing signal terminal. The data writing sub-circuit is configured to transmit the data signal received from the data signal terminal to the third node in response to the second light-emitting timing signal and the scanning timing signal.

In some embodiments, the data writing sub-circuit includes a sixth transistor and a seventh transistor. A control electrode of the sixth transistor is coupled to the second light-emitting timing signal terminal, a first electrode of the sixth transistor is coupled to a second electrode of the seventh transistor, and a second electrode of the sixth transistor is coupled to the third node. A control electrode of the seventh transistor is coupled to the scanning timing signal terminal, and a first electrode of the seventh transistor is coupled to the data signal terminal.

In some embodiments, the pixel driving circuit further includes a reference voltage sub-circuit. The reference voltage sub-circuit is coupled to the third node, the first light-emitting timing signal terminal and a reference voltage signal terminal. The reference voltage sub-circuit is further configured to transmit a reference voltage signal received from the reference voltage signal terminal to the third node in response to the first light-emitting timing signal received from the first light-emitting timing signal terminal.

In some embodiments, the reference voltage sub-circuit includes an eighth transistor. A control electrode of the eighth transistor is coupled to the first light-emitting timing signal terminal, a first electrode of the eighth transistor is coupled to the reference voltage terminal, and a second electrode of the eighth transistor is coupled to the third node.

In some embodiments, the pixel driving circuit further includes a storage sub-circuit and a data writing sub-circuit. The storage sub-circuit is coupled to the second node and a third node. The storage sub-circuit is configured to be charged due to action of voltages of the second node and the third node, change a voltage of the second node according to a voltage of the third node, and maintain the voltage of the second node. The driving sub-circuit is further configured to: reach a self-saturation state in response to the second light-emitting timing signal and due to action of the compensation sub-circuit to generate a compensation signal according to the first voltage received from the first voltage signal terminal signal and transmit the compensation signal to the second node through the compensation sub-circuit, generate a driving signal according to the first voltage signal in response to the second light-emitting timing signal and due to coupling action of the storage sub-circuit.

In some embodiments, the pixel driving circuit further includes a light-emitting device. The reset sub-circuit is further coupled to a light-emitting device. The reset sub-circuit is further configured to transmit the initialization signal received from the initialization signal terminal to the light-emitting device in response to the scanning timing signal receiving from the scanning timing signal terminal, so as to reset the light-emitting device. The light-emitting control sub-circuit is further coupled to the light-emitting device. The light-emitting control sub-circuit is further configured to transmit the driving signal from the driving sub-circuit to the light-emitting device in response to the first light-emitting timing signal, so as to drive the light-emitting device to emit light.

In some embodiments, the reset sub-circuit includes a first transistor. A control electrode of the first transistor is coupled to the scanning timing signal terminal, a first electrode of the first transistor is coupled to the initialization signal terminal, and a second electrode of the first transistor is coupled to the light-emitting control sub-circuit and the light-emitting device. The light-emitting control sub-circuit includes a second transistor. A control electrode of the second transistor is coupled to the first light-emitting timing signal terminal, a first electrode of the second transistor is coupled to the first node, and a second electrode of the second transistor is coupled to the second electrode of the first transistor and the light-emitting device.

In some embodiments, the reset sub-circuit includes a first transistor; the light-emitting control sub-circuit includes a second transistor; the compensation sub-circuit includes a third transistor; and the driving sub-circuit includes a fourth transistor and a fifth transistor. The pixel driving circuit further includes a storage sub-circuit, a data writing sub-circuit, a reference voltage sub-circuit and a light-emitting device. The storage sub-circuit includes a first capacitor. The data writing sub-circuit includes a sixth transistor, or includes the sixth transistor and a seventh transistor. The reference voltage sub-circuit includes an eighth transistor.

A control electrode of the first transistor is coupled to the scanning timing signal terminal, a first electrode of the first transistor is coupled to the initialization signal terminal, and a second electrode of the first transistor is coupled to a second electrode of the second transistor and the light-emitting device. A control electrode of the second transistor is coupled to the first light-emitting timing signal terminal, a first electrode of the second transistor is coupled to the first node, and the second electrode of the second transistor is further coupled to the light-emitting device. A control electrode of the third transistor is coupled to the scanning timing signal terminal, a first electrode of the third transistor is coupled to the first node, and a second electrode of the third transistor is coupled to the second node.

A control electrode of the fourth transistor is coupled to the second node, a first electrode of the fourth transistor is coupled to the first voltage signal terminal, and a second electrode of the fourth transistor is coupled to a first electrode of the fifth transistor. A control electrode of the fifth transistor is coupled to the second light-emitting timing signal terminal, and a second electrode of the fifth transistor is coupled to the first node. Alternatively, the control electrode of the fourth transistor is coupled to the second node, the first electrode of the fourth transistor is coupled to the second electrode of the fifth transistor, and the second electrode of the fourth transistor is coupled to the first node; and the control electrode of the fifth transistor is coupled to the second light-emitting timing signal terminal, and the first electrode of the fifth transistor is coupled to the first voltage signal terminal.

A first end of the first capacitor is coupled to a third node, and a second end of the first capacitor is coupled to the second node. In a case where the data writing sub-circuit includes the sixth transistor, a control electrode of the sixth transistor is coupled to an input control signal terminal, a first electrode of the sixth transistor is coupled to a data signal terminal, and a second electrode of the sixth transistor is coupled to the third node. In a case where the data writing sub-circuit includes the sixth transistor and the seventh transistor, the control electrode of the sixth transistor is coupled to the second light-emitting timing signal terminal, and the first electrode of the sixth transistor is coupled to a second electrode of the seventh transistor, and the second electrode of the sixth transistor is coupled to the third node; and a control electrode of the seventh transistor is coupled to the scanning timing signal terminal, and a first electrode of the seventh transistor is coupled to the data signal terminal.

A control electrode of the eighth transistor is coupled to the first light-emitting timing signal terminal, a first electrode of the eighth transistor is coupled to a reference voltage terminal, and a second electrode of the eighth transistor is coupled to the third node.

In another aspect, a pixel driving method applied to the above pixel driving circuit is provided. The pixel driving circuit further includes a storage sub-circuit, a data writing sub-circuit, a reference voltage sub-circuit, and a light-emitting device. The storage sub-circuit is coupled to the second node and a third node. The data writing sub-circuit is coupled to the third node, an input control signal terminal and a data signal terminal. The reference voltage sub-circuit is coupled to the third node, the first light-emitting timing signal terminal and a reference voltage signal terminal. The reset sub-circuit and the light-emitting control sub-circuit are further coupled to a light-emitting device. A frame period includes a reset stage, an input and compensation stage, and a light-emitting stage. The pixel driving method includes:

In the reset stage: transmitting, by the reference voltage sub-circuit, a reference voltage signal received from the reference voltage signal terminal to the third node, in response to the first light-emitting timing signal received from the first light-emitting timing signal terminal; transmitting, by the reset sub-circuit, the initialization signal received from the initialization signal terminal to the light-emitting control sub-circuit and the light-emitting device, in response to the scanning timing signal received from the scanning timing signal terminal, so as to reset the light-emitting device; transmitting, by the light-emitting control sub-circuit, the initialization signal to the first node, in response to the first light-emitting timing signal received from the first light-emitting timing signal terminal; transmitting, by the compensation sub-circuit, the initialization signal from the first node to the second node, under the control of the scanning timing signal, so as to reset the voltage of the second node; and opening, by the driving sub-circuit, the conductive path from the first voltage signal terminal to the initialization signal terminal, in response to the second light-emitting timing signal received from the second light-emitting timing signal terminal.

In some embodiments, the pixel driving method further includes: in the input and compensation stage, transmitting, by the reset sub-circuit, the initialization signal received from the initialization signal terminal to the light-emitting device, in response to the scanning timing signal received from the scanning timing signal terminal, so as to continuously reset the light-emitting device: transmitting, by the data writing sub-circuit, a data signal received from the data signal terminal to the third node, in response to an input control signal received from the input control signal terminal; reaching, by the driving sub-circuit, the self-saturation state, in response to the second light-emitting timing signal and due to action of the compensation sub-circuit to generate a compensation signal according to a first voltage signal received from the first voltage signal terminal; and transmitting, by the driving sub-circuit, the compensation signal to the second node through the compensation sub-circuit; and charging the storage sub-circuit due to action of voltages of the second node and the third node;

in the light-emitting stage, transmitting, by the reset sub-circuit, the reference voltage signal received from the reference voltage signal terminal to the third node, in response to the first light-emitting timing signal received from the first light-emitting timing signal terminal: changing, by the storage sub-circuit, a voltage of the second node, due to action of a voltage of the third node; and maintaining, by the storage sub-circuit, the voltage of the second node; generating, by the driving sub-circuit, a driving signal, in response to the second light-emitting timing signal and due to coupling action of the storage sub-circuit, and transmitting, by the driving sub-circuit, the driving signal to the light-emitting control sub-circuit; and transmitting, by the light-emitting control sub-circuit, the driving signal from the driving sub-circuit to the light-emitting device, in response to the first light-emitting timing signal, so as to drive the light-emitting device to emit light.

In some embodiments, the data writing sub-circuit includes a sixth transistor, a control electrode of the sixth transistor is coupled to the input control signal terminal, a first electrode of the sixth transistor is coupled to the data signal terminal, and a second electrode of the sixth transistor is coupled to the third node. The pixel driving method further includes: in the input and compensation stage, turning on the sixth transistor, under control of the input control signal, so as to transmit the data signal to the third node.

Alternatively, the input control signal terminal and the second light-emitting timing signal terminal are configured to transmit the same signal, the data writing sub-circuit is further coupled to the scanning timing signal terminal, the data writing sub-circuit includes the sixth transistor and a seventh transistor, the control electrode of the sixth transistor is coupled to the second light-emitting timing signal terminal, the first electrode of the sixth transistor is coupled to a second electrode of the seventh transistor, the second electrode of the sixth transistor is coupled to the third node, a control electrode of the seventh transistor is coupled to the scanning timing signal terminal, and a first electrode of the seventh transistor is coupled to the data signal terminal. The pixel driving method further includes: in the input and compensation stage, turning on the seventh transistor, under control of the scanning timing signal, so as to transmit the data signal to the first electrode of the sixth transistor, and the sixth transistor is turned on under control of the first light-emitting timing signal, so as to transmit the data signal to the third node.

In still another aspect, a display panel is provided. The display panel includes pixel driving circuits as described above.

In some embodiments, the display panel includes a plurality of sub-pixels. A sub-pixel includes a pixel driving circuit. The plurality of sub-pixels are arranged in an array with a plurality of rows and a plurality of columns. The display panel further includes a plurality of scanning timing signal lines and a plurality of light-emitting timing signal lines that extend in a row direction. Scanning timing signal terminals of pixel driving circuits included in an nth row of sub-pixels are coupled to an nth scanning timing signal line. First light-emitting timing signal terminals of the pixel driving circuits included in the nth row of sub-pixels are coupled to an nth light-emitting timing signal line. Other than a first row of sub-pixels, second light-emitting timing signal terminals of the pixel driving circuits included in the nth row of sub-pixels are coupled to an (n−1)th light-emitting timing signal line.

In still another aspect, a display apparatus is provided. The display apparatus includes the above display panel.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person having ordinary skill in the art can obtain other drawings according to these accompanying drawings. In addition, the accompanying drawings in the following description may be regarded as schematic diagrams, and are not limitations on an actual size of a product, an actual process of a method and an actual timing of a signal involved in the embodiments of the present disclosure.

DETAILED DESCRIPTION

Technical solutions in some embodiments of the present disclosure will be described clearly and completely below with reference to the accompanying drawings. Obviously, the described embodiments are merely some but not all embodiments of the present disclosure. All other embodiments obtained by a person having ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the term such as "one embodiment", "some embodiments", "exemplary embodiments", "example", "specific example" or "some examples" is intended to indicate that specific features, structures, materials or characteristics related to the embodiment(s) or example(s) are included in at least one embodiment or example of the present disclosure. Schematic representation of the above term does not necessarily refer to the same embodiment(s) or examples(s). In addition, the specific features, structures, materials or characteristics may be included in any one or more embodiments or examples in any suitable manner.

Hereinafter, the terms such as "first" and "second" are used for descriptive purposes only, and are not to be construed as indicating or implying the relative importance or implicitly indicating the number of indicated technical features. Thus, the features defined with "first" and "second" may explicitly or implicitly include one or more of the features. In the description of the embodiments of the present disclosure, the term "a plurality of/the plurality of" means two or more unless otherwise specified.

Some embodiments may be described using the terms "coupled", "connected" and their derivatives. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the content herein.

The phrase "applicable to" or "configured to" as used herein indicates an open and inclusive expression, which does not exclude devices that are applicable to or configured to perform additional tasks or steps.

Figure 1:
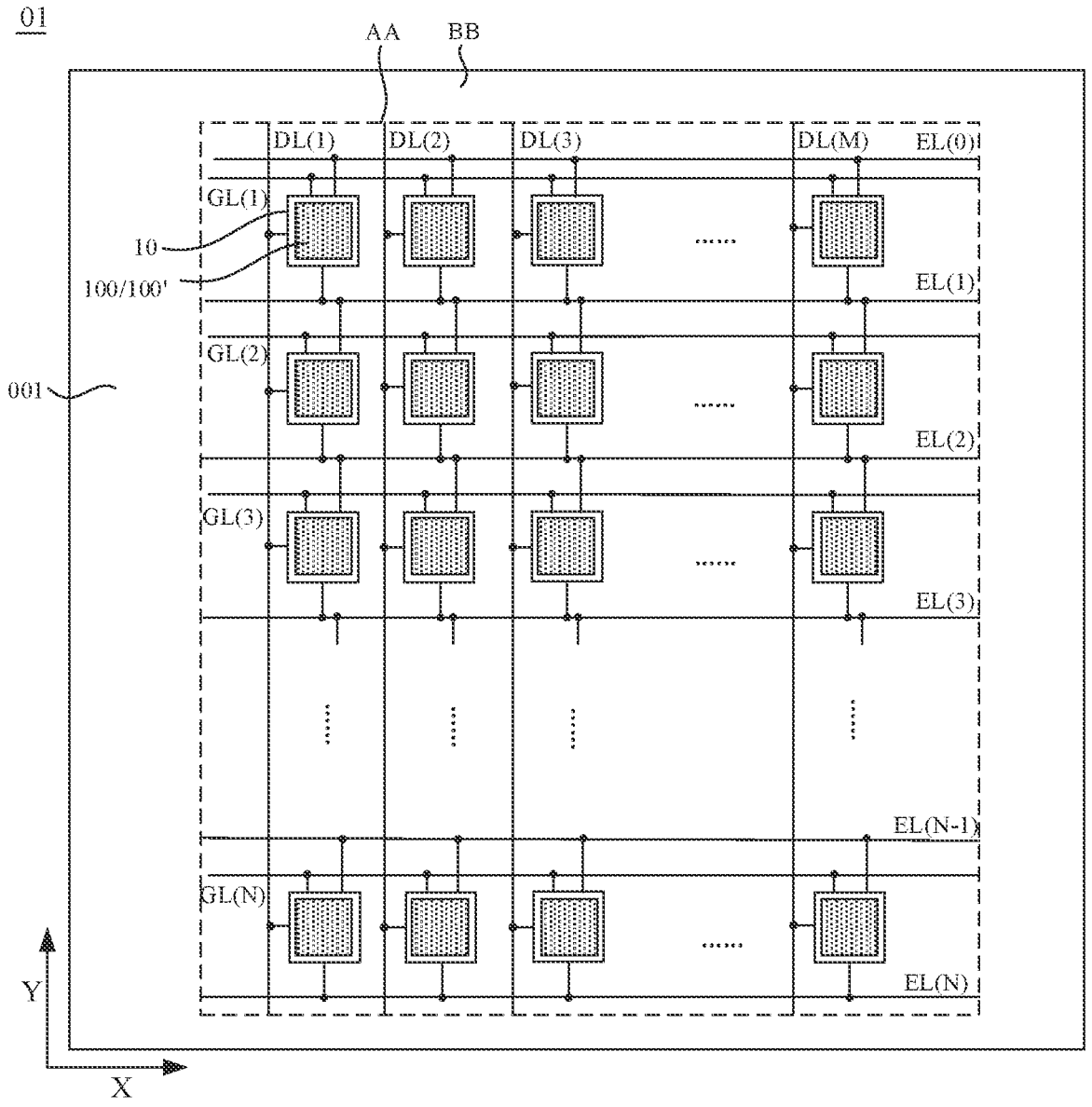
FIG. 1 is a structural diagram of a display panel, in accordance with some embodiments.

In a display apparatus, the display apparatus includes a display panel 01. As shown in FIG. 1, the display panel 01 includes an active area AA (also being referred as an active display area) and a peripheral area BB located on at least one side of the active area AA.

The active area AA is provided therein with a plurality of sub-pixels 10, a plurality of scanning timing signal lines GL and a plurality of light-emitting timing signal lines EL extending in a horizontal direction X, and a plurality of data signal lines DL extending in a vertical direction Y. For convenience, the plurality of sub-pixels 10 in the present disclosure are described by taking an example in which they are arranged in a matrix form. For example, the plurality of sub-pixels 10 are arranged in N rows and in M columns. In this case, sub-pixels 10 arranged in a line in the horizontal direction X are referred as a row of sub-pixels, and sub-pixels 10 arranged in a line in the vertical direction Y are referred as a column of sub-pixels. A row of sub-pixels may be coupled to one or two scanning timing signal lines GL, and the row of sub-pixels may further be coupled to one or two light-emitting timing signal lines EL. A column of sub-pixels may be coupled to one data signal line DL. A sub-pixel 10 is provided therein with a pixel driving circuit 100 for controlling the sub-pixel 10 to perform display. Pixel driving circuits 100 are provided on a base substrate 001 of the display panel 01.

The display panel 01 may be an organic light-emitting diode (OLED) display panel, a quantum dot light-emitting diode (QLED) display panel, or the like, which is not specifically limited in the present disclosure.

The following embodiments of the present disclosure are all described by taking an example in which the display panel 01 is an OLED display panel to illustrate the present disclosure.

For example, the pixel driving circuit 100 generally includes elements such as a switching transistor, a driving transistor and a storage capacitor. Two opposite ends of the storage capacitor are a reference potential end (an end for being at reference potential) and a signal holding end (an end for holding a signal), respectively. The signal holding end of the storage capacitor is coupled to a control electrode (a gate) of the driving transistor.

Figure 2A:
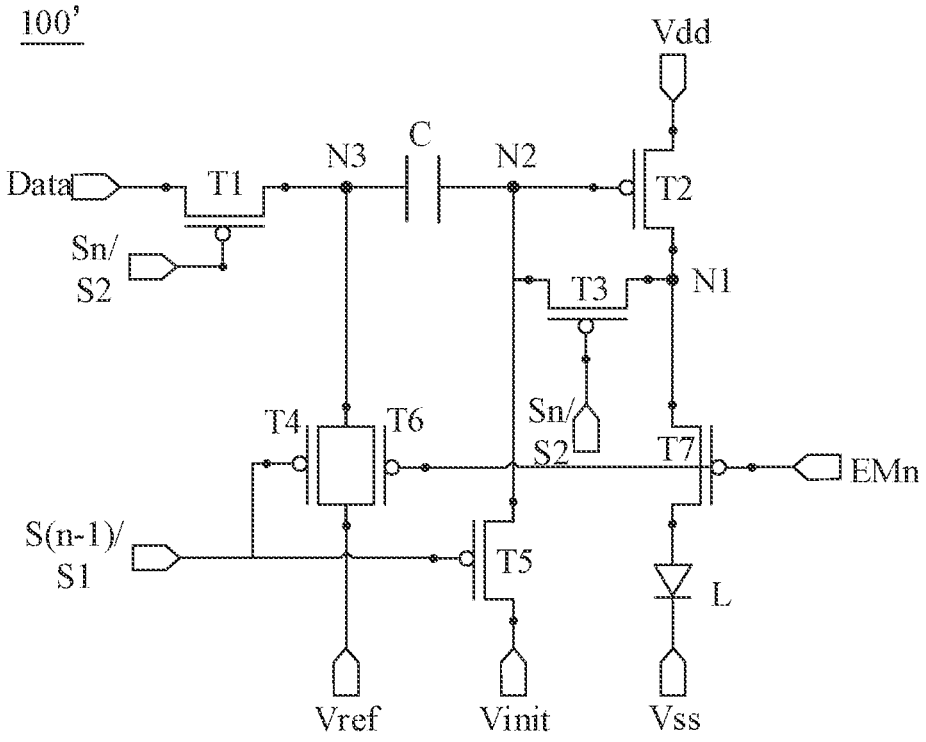
FIG. 2A is a structural diagram of a pixel driving circuit, in the related art.

As shown in FIG. 2A, a pixel driving circuit 100' with a 7T1C structure is provided in related art. The pixel driving circuit 100' includes a switching transistor T1, a storage capacitor C, a driving transistor T2, a compensation transistor T3, a first reset transistor T4, a second reset transistor T5, a first control transistor T6 and a second control transistor T7. As for a connection relationship between these transistors, reference may be made to the drawing. A node where the driving transistor T2, the compensation transistor T3 and the second control transistor T7 are coupled to each other is a first node N1. A reference voltage terminal of the storage capacitor C is coupled to a third node N3, and a signal holding end of the storage capacitor C is coupled to a second node N2. A control electrode of the driving transistor T2 is coupled to the second node N2.

In a light-emitting stage of a process of driving the pixel driving circuit 100', the storage capacitor is used for holding a voltage signal, so as to keep a voltage of the signal holding end constant and generate a voltage between the gate and a source of the driving transistor. Such a voltage controls the driving transistor to generate a driving current, and then a light-emitting diode is driven to emit light. In this process, since an electric leakage path exists at a node where the signal holding end of the storage capacitor and the control electrode of the driving transistor are coupled to each other, the potential of the signal holding end of the storage capacitor cannot be kept constant for long. Consequently, the driving current generated by the driving transistor is unstable, which affects a light-emitting brightness of the light-emitting device, thereby affecting display effects of the display apparatus.

In conjunction with FIG. 2B, a process of driving the pixel driving circuit 100' is as follows. A frame period includes a reset stage P1, an input and compensation stage P2 and a light-emitting stage P3. In the reset stage P1, under control of a first scanning timing signal s1 transmitted by a first scanning timing signal terminal S1, the first reset transistor T4 is turned on to transmit a reference voltage signal vref received from a reference voltage terminal Vref to the third node N3, and the second reset transistor T5 is turned on to transmit an initialization signal vinit received from an initialization signal terminal Vinit to the second node N2, so that a voltage of the second node N2 is reset, thereby resetting the signal holding end of the storage capacitor C.

In the input and compensation stage P2, under control of a second scanning timing signal s2 transmitted by a second scanning timing signal terminal S2, the switching transistor T1 is turned on to transmit a data signal data received from a data signal terminal Data to the third node N3, and the compensation transistor T3 is turned on to couple the control electrode of the driving transistor T2 to a second electrode of the driving transistor T2, so that the driving transistor T2 reaches a self-saturation state. Thus, a first voltage signal vdd received from a first voltage signal terminal Vdd and a threshold voltage $V_{th}$ of the driving transistor T2 are written to the second node N2. The storage capacitor C is charged due to action of the third node N3 and the second node N2.

In the light-emitting stage P3, under control of a light-emitting timing signal emn transmitted by the light-emitting timing signal terminal EMn, the first control transistor T6 is turned on to transmit the reference voltage signal vref received from the reference voltage terminal Vref to the third node N3. That is, a voltage of the reference voltage terminal of the storage capacitor C changes from a voltage of the data signal data to a voltage of the reference voltage signal vref. The storage capacitor C makes a voltage of the signal holding end thereof change by a same voltage difference through coupling action. That is, due to action of the storage capacitor C, the voltage of the second node N2 jumps as the voltage of the third node N3 changes. Since the driving transistor T2 is turned on, the driving transistor T2 generates a driving signal according to the first voltage signal vdd from the first voltage signal terminal Vdd. The second control transistor T7 is turned on, under the control of the light-emitting timing signal emn, to transmit the driving signal to a light-emitting diode L, so as to drive the light-emitting diode L to emit light.

Figure 2B:
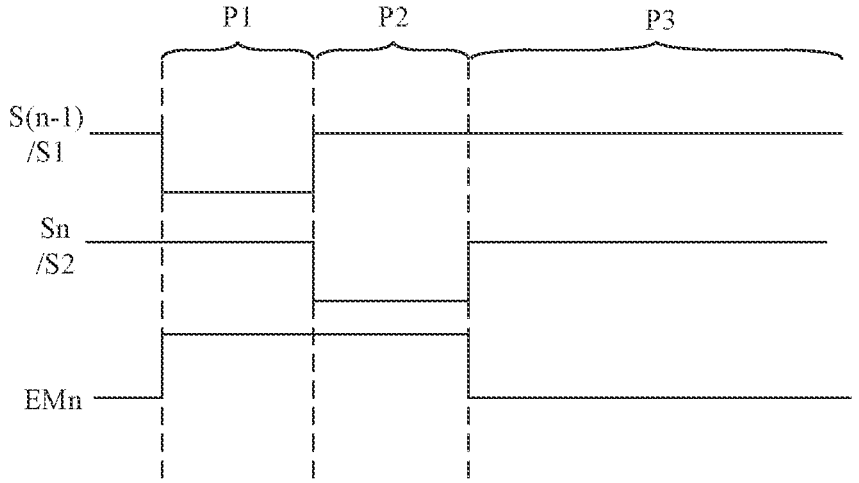
FIG. 2B is a timing diagram corresponding to a pixel driving circuit in FIG. 2A.

It will be noted that, as shown in FIGS. 1, 2A and 2B, in the display panel 01, the plurality of sub-pixels 10 are arranged in an array. A first scanning signal s1, from a first scanning timing terminal S1, received by pixel driving circuits 100' in a row of sub-pixels is the same as a second scanning timing signal s2, from a second scanning timing signal terminal S2, received by pixel driving circuits 100' in a previous row of sub-pixels. That is, first scanning signal terminals S1 of pixel driving circuits 100' in an nth row of sub-pixels and second scanning signal terminals S2 of pixel driving circuits 100' in an (n−1)th row of sub-pixels are coupled to a same scanning timing signal line GL (an (n−1)th scanning timing signal line GL). In this way, a single scanning timing signal line GL is coupled to both a row of sub-pixels in front of the scanning timing signal line GL and a row of sub-pixels behind the scanning timing signal line GL, so as to achieve a sharing of the scanning timing signal line GL. For example, as shown in FIGS. 2A and 2B, as for a pixel driving circuit in the nth row of sub-pixels, a first scanning timing signal terminal S1 thereof is also represented by S(n−1), and a second scanning timing signal terminal S2 thereof is also represented by Sn.

During a light-emitting process of the light-emitting diode L in an entire light-emitting stage P3 of the frame period, the driving signal generated by the driving transistor T2 is a driving current. According to the calculation formula of the driving current: $I=\beta(V_{gs}-V_{th})^2$, where $V_{gs}$ is a gate-source voltage difference of the driving transistor T2, the driving signal generated by the driving transistor T2 is related to a voltage of the gate of the driving transistor. Stability of the voltage of the gate of the driving transistor T2 may affect stability and an effective value of the generated driving signal, thereby affecting stability and continuity of light emission of the light-emitting diode. The gate of the driving transistor T2 is coupled to the second node N2, so a voltage holding ratio of the second node N2 will affect light-emitting effects of the light-emitting device. The voltage of the second node N2 is consistent with the voltage of the signal holding end of the storage capacitor C. That is, the higher the voltage holding ratio of the storage capacitor C is, the more stable the light-emitting brightness of the light-emitting diode is, and the better the light-emitting effects are.

A transistor has an off-state current in an off-state, and the off-state current is also referred as a leakage current. In the light-emitting stage P3, the compensation transistor T3 and the second reset transistor T5 that are coupled to the second node N2 are both turned off. In this case, the compensation transistor T3 and the second reset transistor T5 have leakage currents, which will cause electric leakage at the second node N2. Consequently, the voltage holding ratio of the second node N2 is reduced.

As shown in FIG. 2A, two electric leakage paths are included in the pixel driving circuit 100'. The two electric leakage paths are a first electric leakage path from the second node N2 to the first node N1 through the compensation transistor T3, and a second electric leakage path from the second node N2 to the initialization signal terminal Vinit through the second reset transistor T5. In addition, a voltage difference between the second node N2 and the initialization signal terminal Vinit is greater than a voltage difference between the second node N2 and the first node N1. Therefore, an electric leakage amount (an absolute value) of the second electric leakage path is much greater than an electric leakage amount (an absolute value) of the first electric leakage path. Consequently, in the light-emitting stage P3, due to the electric leakage through the two electric leakage paths, charges at the second node N2 leak seriously, which causes an insufficient voltage holding ratio of the storage capacitor C and then makes the driving signal output by the driving transistor T2 unstable. Thus, the light-emitting brightness of the light-emitting device changes too much, and stability thereof is poor, which results in visual flickering. In addition, there are differences between elements of pixel driving circuits in the display apparatus due to process factors. As a result, leakage degrees of second nodes N2 of the pixel driving circuits are not the same, which causes non-uniform light-emitting brightnesses of light-emitting devices driven by the pixel driving circuits and then causes abnormal display such as uneven display on a display screen.

Figure 3:
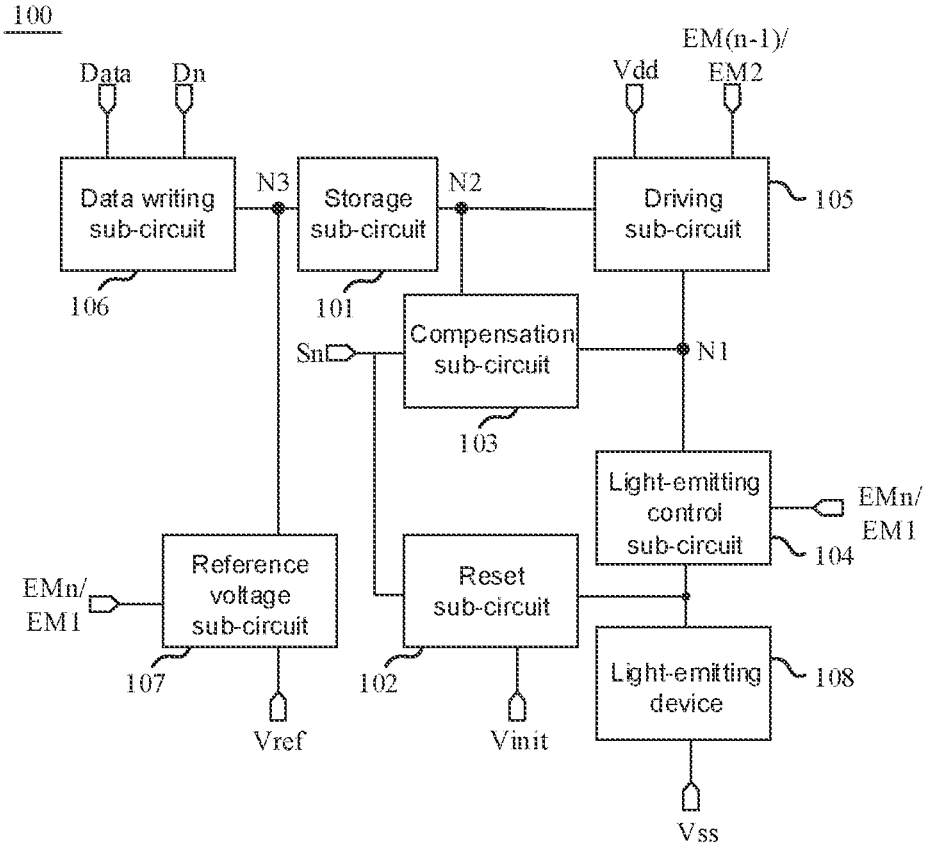
FIG. 3 is a structural diagram of a pixel driving circuit, in accordance with some embodiments of the present disclosure.
Figure 4:
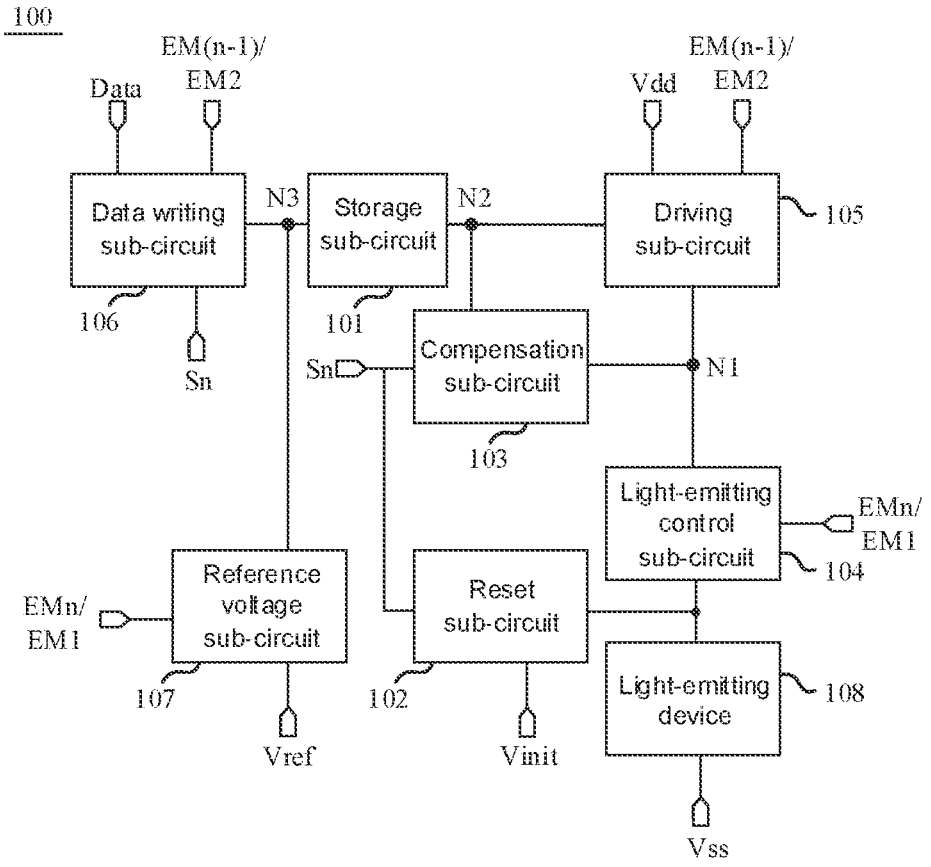
FIG. 4 is a structural diagram of another pixel driving circuit, in accordance with some embodiments of the present disclosure.

In light of this, some embodiments of the present disclosure provide a pixel driving circuit 100. As shown in FIGS. 3 and 4, the pixel driving circuit 100 includes: a storage sub-circuit 101, a reset sub-circuit 102, a compensation sub-circuit 103, a light-emitting control sub-circuit 104, a driving sub-circuit 105, a data writing sub-circuit 106 and a reference voltage sub-circuit 107.

The storage sub-circuit 101 is coupled to a second node N2 and a third node N3. The reset sub-circuit 102 is coupled to the light-emitting control sub-circuit 104, a scanning timing signal terminal Sn and an initialization signal terminal Vinit. The light-emitting control sub-circuit 104 is further coupled to a first node N1 and a first light-emitting timing signal terminal EM1. The compensation sub-circuit 103 is coupled to the first node N1, the second node N2 and the scanning timing signal terminal Sn. The driving sub-circuit 105 is coupled to the first node N1, the second node N2, a first voltage signal terminal Vdd and a second light-emitting timing signal terminal EM2.

The storage sub-circuit 101 is configured to be charged due to action of voltages of the second node N2 and the third node N3, perform coupling on a voltage of the second node N2 according to a voltage of the third node N3 to change the voltage of the second node N2, and maintain the voltage of the second node N2.

The reset sub-circuit 102 is configured to transmit an initialization signal vinit received from an initialization signal terminal Vinit to the light-emitting control sub-circuit 104 in response to a scanning timing signal sn received from the scanning timing signal terminal Sn.

The light-emitting control sub-circuit 104 is configured to transmit the initialization signal vinit to the first node N1 in response to a first light-emitting timing signal em1 received from the first light-emitting timing signal terminal EM1.

The compensation sub-circuit 103 is configured to transmit the initialization signal vinit from the first node N1 to the second node N2 under control of the scanning timing signal sn, so as to reset the voltage of the second node N2.

That is to say, the reset sub-circuit 102 is configured to transmit the initialization signal vinit to the second node N2 through the light-emitting control sub-circuit 104 and the compensation sub-circuit 103, so as to reset a voltage of the second node N2. In a reset stage, a process of transmitting the initialization signal vinit to the second node N2 is as follows. The initialization signal vinit transmitted by the initialization signal terminal Vinit passes through the reset sub-circuit 102, the light-emitting control sub-circuit 104, the first node N1 and the compensation sub-circuit 103 in sequence, and finally is transmitted to the second node N2 to reset the voltage of the second node N2.

In some examples, the reset sub-circuit 102 is further coupled to a light-emitting device 108. The reset sub-circuit 102 is configured to transmit the initialization signal vinit received from the initialization signal terminal Vinit to the light-emitting device 108 in response to the scanning timing signal sn received from the scanning timing signal terminal Sn, so as to reset the light-emitting device 108.

The driving sub-circuit 105 is configured to open a conductive path from a first voltage signal terminal Vdd to the initialization signal terminal Vinit in response to a second light-emitting timing signal em2 received from the second light-emitting timing signal terminal EM2 in a process of resetting the voltage of the second node N2.

The driving sub-circuit 105 is further configured to reach a self-saturation state in response to the second light-emitting timing signal em2 and due to action of the compensation sub-circuit 103 to generate a compensation signal according to a first voltage signal vdd received from the first voltage signal terminal Vdd, and transmit the compensation signal to the second node N2.

In an input and compensation stage, the driving sub-circuit 105 is configured to generate the compensation signal and transmit the compensation signal to the second node N2. In this stage, the compensation sub-circuit 103 is further configured to bring the driver sub-circuit 105 into the self-saturation state under the control of the scanning timing signal sn.

The driving sub-circuit 105 is further configured to generate a driving signal according to the first voltage signal vdd in response to the second light-emitting timing signal em2 and due to coupling action of the storage sub-circuit 101, and transmit the driving signal to the light-emitting control sub-circuit 104.

The light-emitting control sub-circuit 104 is further coupled to the light-emitting device 108. The light-emitting control sub-circuit 104 is further configured to transmit the driving signal from the driving sub-circuit 105 to the light-emitting device 108 in response to the first light-emitting timing signal em1, so as to drive the light-emitting device 108 to emit light.

The data writing sub-circuit 106 is coupled to the third node N3 and the data signal terminal Data. The data writing sub-circuit 106 is configured to transmit data signal data received from the data signal terminal Data to the third node N3 in the input and compensation stage. In this stage, the storage sub-circuit 101 is charged according to a voltage of the third node N3, and stores the data signal data.

Two exemplary structures of the data writing sub-circuit 106 are to be described below. In some examples, as shown in FIG. 3, the data writing sub-circuit 106 is coupled to the third node N3, an input control signal terminal Dn and the data signal terminal Data. The data writing sub-circuit 106 is configured to transmit the data signal data received from the data signal terminal Data to the third node N3 in response to an input control signal dn received from the input control signal terminal Dn.

In some other examples, as shown in FIG. 4, the input control signal terminal Dn is the second light-emitting timing signal terminal EM2, and the data writing sub-circuit 106 is further coupled to the scanning timing signal terminal Sn. That is to say, the data writing sub-circuit 106 is coupled to the third node N3, the second light-emitting timing signal terminal EM2, the scanning timing signal terminal Sn and the data signal terminal Data. The data writing sub-circuit 106 is configured to transmit the data signal data received from the data signal terminal Data to the third node N3 in response to the second light-emitting timing signal em2 and the scanning timing signal sn.

The reference voltage sub-circuit 107 is coupled to the third node N3, the first light-emitting timing signal terminal EM1 and the reference voltage signal terminal Vref. The reference voltage sub-circuit 107 is configured to transmit a reference voltage signal vref received from the reference voltage signal terminal Vref to the third node N3 in response to the first light-emitting timing signal em1 received from the first light-emitting timing signal terminal EM1, so as to maintain the voltage of the third node N3 at a reference voltage. In embodiments of the present disclosure, a voltage of the reference voltage signal vref is the reference voltage.

It will be noted that, as shown in FIGS. 1, 3 and 4, in the display panel 01, the plurality of sub-pixels 10 are arranged in an array. A second light-emitting timing signal em2 received by pixel driving circuits 100 in a row of sub-pixels from second light-emitting timing signal terminals EM2 is the same as a first light-emitting timing signal em1 received by pixel driving circuits 100 in a previous row of the sub-pixels from first light-emitting timing signal terminals EM1. That is, second light-emitting timing signal terminals EM2 of pixel driving circuits 100 in an nth row of sub-pixels and first light-emitting timing signal terminals EM1 of pixel driving circuits 100 in an (n−1)th row of sub-pixels are coupled to a same light-emitting timing signal line EL (an (n−1)th light-emitting timing signal line EL). That is, a single light-emitting timing signal line EL is coupled to both a row of sub-pixels in front of the light-emitting timing signal line GL and a row of sub-pixels behind the light-emitting timing signal line EL, so as to achieve a sharing of the scanning timing signal line GL. For example, as shown in FIGS. 3 and 4, as for a pixel driving circuit in the nth row of sub-pixels, a first light-emitting timing signal terminal EM1 thereof is also represented by EMn, and a second light-emitting timing signal terminal EM2 thereof is also represented by EM (n−1).

By adopting the method of combining adjacent light-emitting timing signal lines, a number of the light-emitting timing signal lines EL required in the display panel 01 may be reduced, which reduces manufacturing difficulty and costs of the display panel 01.

Figure 7:
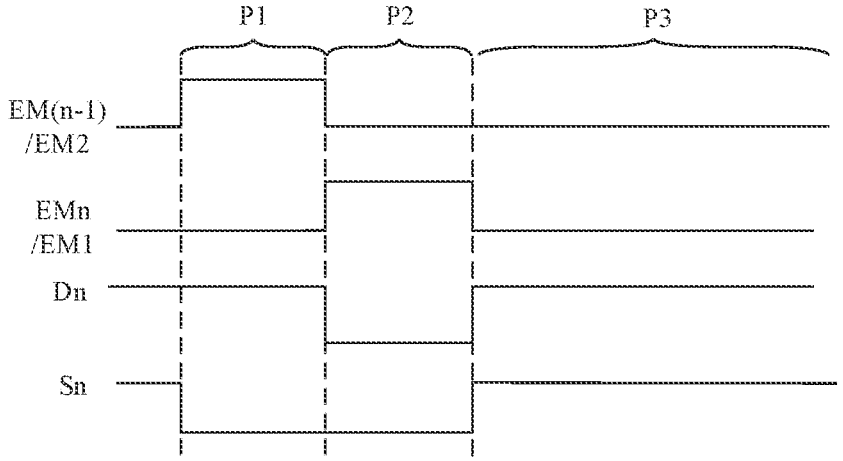
FIG. 7 is a timing diagram corresponding to the pixel driving circuits in FIGS. 3, 5 and 6.

The pixel driving circuit 100 provided in embodiments of the present disclosure includes the storage sub-circuit 101, the reset sub-circuit 102, the compensation sub-circuit 103, the light-emitting control sub-circuit 104, the driving sub-circuit 105, the data writing sub-circuit 106 and the reference voltage sub-circuit 107, in conjunction with FIGS. 7 and 10, a process of driving the pixel driving circuit 100 is as follows.

In the reset stage P1, the reference voltage sub-circuit 107 transmits the reference voltage signal vref to the third node N3, while the reset sub-circuit 102 transmits the initialization signal vinit to the second node N2 through the light-emitting control sub-circuit 104 and the compensation sub-circuit 103, so as to reset the voltage of the second node N2. In addition, in this stage, the driving sub-circuit 105 opens the conductive path from the first voltage signal terminal Vdd to the initialization signal terminal Vinit under the control of the second light-emitting timing signal em2.

In an input and compensation stage P2, the data writing sub-circuit 106 transmits the data signal data to the third node N3, while the compensation sub-circuit 103 is turned on, which makes the driving sub-circuit 105 reach the self-saturation state, so that the driving sub-circuit 105 generates the compensation signal and transmits the compensation signal to the second node N2. In this case, the storage sub-circuit 101 is charged to store the data signal data and the compensation signal due to the action of the voltages of the third node N3 and the second node N2.

In a light-emitting stage P3, the reset sub-circuit 102 transmits the reference voltage signal vref to the third node N3; the storage sub-circuit 101 performs coupling on the voltage of the second node due to the action of the voltage of the third node N3, so that the voltage of the node N2 jumps; and the driving sub-circuit 105 generates and outputs the driving signal in response to the second light-emitting timing signal em2 and due to discharge action of the storage sub-circuit 101. The light-emitting control sub-circuit 104 transmits the driving signal to the light-emitting device 108, so that the light-emitting device 108 is driven to emit light.

In the pixel driving circuit 100, the compensation sub-circuit 103 is coupled between the first node N1 and the second node N2. In the reset stage, a process of resetting the voltage of the second node N2 by the reset sub-circuit 102 is: transmitting the initialization signal vinit to the second node N2 through the light-emitting control sub-circuit 104 and the compensation sub-circuit 103. In the input and compensation stage, the compensation sub-circuit 103 is turned on under the control of the scanning timing signal sn, so that the driving sub-circuit 105 reaches the self-saturated state, and then generates the compensation signal, which realizes a compensation of the threshold voltage thereof. That is, the compensation sub-circuit 103 is used to perform both a compensation function and a reset function. By time-division multiplexing of making the compensation sub-circuit 103 be used in a time-share manner, the reset of the storage sub-circuit 10 and the compensation of the threshold voltage are realized. In this way, as shown in FIGS. 3 and 4, the reset sub-circuit 102 is not directly coupled to the second node N2, so no electric leakage path is generated between the second node N2 and the initialization signal terminal Vinit during the light-emitting stage. That is, there is only a single electric leakage path from the second node N2 to the first node N1 through the compensation sub-circuit 103 in the pixel driving circuit 100 provided in the embodiments of the present disclosure.

In this way, in the light-emitting stage, the transistor included in the compensation sub-circuit 103 is in an off state, and the second node N2 only leaks electricity through the compensation sub-circuit 103. In addition, as mentioned in the related art, since the voltage difference between the second node N2 and the initialization signal terminal Vinit is greater than the voltage difference between the second node N2 and the first node N1, the electric leakage amount (the absolute value) of the second electric leakage path is much greater than the electric leakage amount (the absolute value) of the first electric leakage path. Therefore, it is equivalent to that only a first electric leakage path with less leakage is included in the pixel driving circuit 100 provided in the embodiments of the present disclosure, and thereby the electric leakage of the second node N2 is significantly reduced, which improves a voltage holding ratio of the storage sub-circuit 101. In the light-emitting stage, a voltage of the signal holding terminal of the storage sub-circuit 101 may be kept constant for a long time, and the voltage of the second node N2 may be kept for a longer time. In this way, under the control of the second node N2, stability of the driving signal generated by the driving sub-circuit 105 is high, which improves stability and continuity of a light-emitting brightness of the light-emitting device 108. Therefore, visual flickering is lessened and a problem of uneven display caused by non-uniform brightnesses of the plurality of light-emitting devices 108 is ameliorated, which improves the display effects.

It will be known to those skilled in the art that, the driving sub-circuit 105 at least includes a driving transistor, and a control electrode of the driving transistor is coupled to the storage sub-circuit 101, i.e., coupled to the second node N2. In the reset stage, as the reset sub-circuit 102 transmits the initialization signal vinit to the second node N2 to reset the voltage of the second node N2, a working state of the driving transistor changes from a saturated driving state in a light-emitting stage of a previous frame to a linear conduction state in the reset stage of the current frame. In this case, with reference to FIGS. 3 and 4, in a process of resetting the voltage of the second node N2 by the reset sub-circuit 102, the reset sub-circuit 102 and the light-emitting control sub-circuit 104 are both turned on, and the driving transistor is turned on under the control of the voltage of the second node N2. In this way, the conductive path from the first voltage signal terminal Vdd to the initialization signal terminal Vinit will generated in the pixel driving circuit 100. For example, the conductive path is a direct current path, which generates a large direct current to cause an invalid power consumption, thereby adversely affecting a normal operation of the pixel driving circuit 100.

However, in the embodiments of the present disclosure, since the driving sub-circuit 105 is further coupled to the second light-emitting timing signal terminal EM2, the driving sub-circuit 105 will open the conductive path from the first voltage signal terminal Vdd to the initialization signal terminal Vinit in response to the second light-emitting timing signal em2 received from the second light-emitting timing signal terminal EM2 in the process of resetting the voltage of the second node N2. In this way, no matter whether the driving transistor is turned on or not in the reset stage, no direct current path will be generated between the first voltage signal terminal Vdd and the initialization signal terminal Vinit under the control of the second light-emitting timing signal em2. Therefore, the large direct current and the invalid power consumption are avoided, which reduces the power consumption and improves reliability of the pixel driving circuit 100.

In addition, the data writing sub-circuit 106 is coupled to the third node N3, the input control signal terminal Dn and the data signal terminal Data; alternatively, the data writing sub-circuit 106 is coupled to the third node N3, the second light-emitting timing signal terminal EM2, the scanning timing signal terminal Sn and the data signal terminal Data. The data writing sub-circuit 106 is controlled by a signal transmitted by the input control signal terminal Dn that is provided independently; alternatively, the data writing sub-circuit 106 is jointly controlled by signals transmitted by the second light-emitting timing signal terminal EM2 and the scanning timing signal terminal Sn. The data signal data is written in the input and compensation stage, which does not occupy a time during which the reset sub-circuit 102 resets the storage sub-circuit 101. Since the reset of the storage sub-circuit 101 and the writing of the data signal data are performed in separate periods, it may be possible to ensure a sufficient reset of the storage sub-circuit 101 and a sufficient writing of the data signal data.

Specific structures of the storage sub-circuit 101, the reset sub-circuit 102, the compensation sub-circuit 103, the light-emitting control sub-circuit 104, the driving sub-circuit 105, the data writing sub-circuit 106 and the reference voltage sub-circuit 107 included in the pixel driving circuit 100 are to be separately introduced below.

In some examples, as shown in FIGS. 5, 6, 8 and 9, the storage sub-circuit 101 includes a first capacitor C. A first end (a reference voltage end) of the first capacitor C is coupled to the third node N3, and a second end (a signal holding end) of the first capacitor C is coupled to the second node N2.

The reset sub-circuit 102 includes a first transistor M1. A control electrode of the first transistor M1 is coupled to the scanning timing signal terminal Sn, a first electrode of the first transistor M1 is coupled to the initialization signal terminal Vinit, and a second electrode of the first transistor M1 It is coupled to the light-emitting control sub-circuit 104. The first transistor M1 is configured to transmit the initialization signal vinit received from the initialization signal terminal Vinit to the light-emitting control sub-circuit 104 in response to the scanning timing signal sn received from the scanning timing signal terminal Sn.

The second electrode of the first transistor M1 is further coupled to a light-emitting device 108. The first transistor M1 is further configured to transmit the initialization signal vinit received from the initialization signal terminal Vinit to the light-emitting device 108 in response to the scanning timing signal sn received from the scanning timing signal terminal Sn, so as to reset the light-emitting device 108.

The reference voltage sub-circuit 107 includes an eighth transistor M8. A control electrode of the eighth transistor M8 is coupled to the first light-emitting timing signal terminal EM1, a first electrode of the eighth transistor M8 is coupled to the reference voltage signal terminal Vref, and a second electrode of the eighth transistor M8 is coupled to the third node N3. The eighth transistor M8 is configured to transmit the reference voltage signal vref received from the reference voltage signal terminal Vref to the third node N3 in response to the first light-emitting timing signal em1 received from the first light-emitting timing signal terminal EM1.

The light-emitting control sub-circuit 104 includes a second transistor M2. A control electrode of the second transistor M2 is coupled to the first light-emitting timing signal terminal EM1, a first electrode of the second transistor M2 is coupled to the first node N1, and a second electrode of the second transistor M2 is coupled to the second electrode of the first transistor M1. The second transistor M2 is configured to transmit the initialization signal vinit signal from the reset sub-circuit 102 (the first transistor M1 of the reset sub-circuit 102) to the first node N1 in response to the first light-emitting timing signal em1 received from the first light-emitting timing signal terminal EM1 in the reset stage.

In some examples, the second electrode of the second transistor M2 is further coupled to the light-emitting device 108. The second transistor M2 is further configured to transmit the driving signal from the first node N1 (or the driving sub-circuit 105) to the light-emitting device 108 in response to the first light-emitting timing signal em1 received from the first light-emitting timing signal terminal EM1 in the light-emitting stage.

The compensation sub-circuit 103 includes a third transistor M3. A control electrode of the third transistor M3 is coupled to the scanning timing signal terminal Sn, a first electrode of the third transistor M3 is coupled to the first node N1, and a second electrode of the third transistor M3 is coupled to the second node N2. The third transistor M3 is configured to: transmit the initialization signal vinit from the first node N1 to the second node N2 in response to the scanning timing signal sn received from the scanning timing signal terminal Sn in the reset stage to reset the second node N2, and be turned on under the control of the scanning timing signal sn, so that the driving sub-circuit 105 generates a self-saturation effect to generate the compensation signal in the input and compensation stage.

In some embodiments, the driving sub-circuit 105 includes a fourth transistor M4 and a fifth transistor M5. The fourth transistor M4 is the driving transistor.

Figure 5:
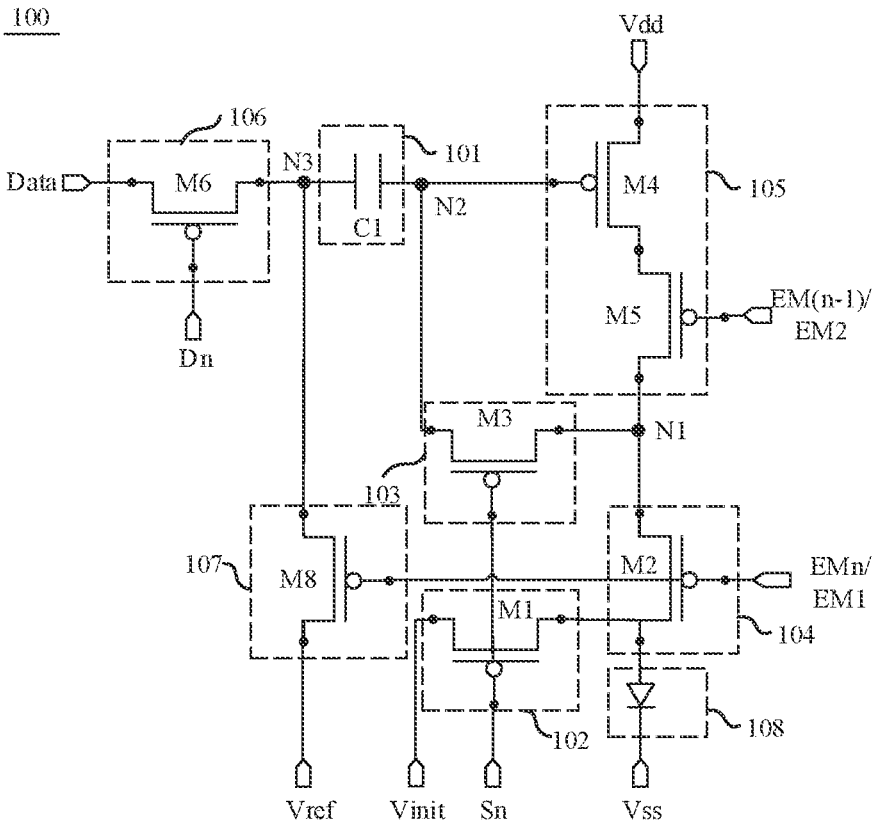
FIG. 5 is a structural diagram of still another pixel driving circuit, in accordance with some embodiments of the present disclosure.
Figure 8:
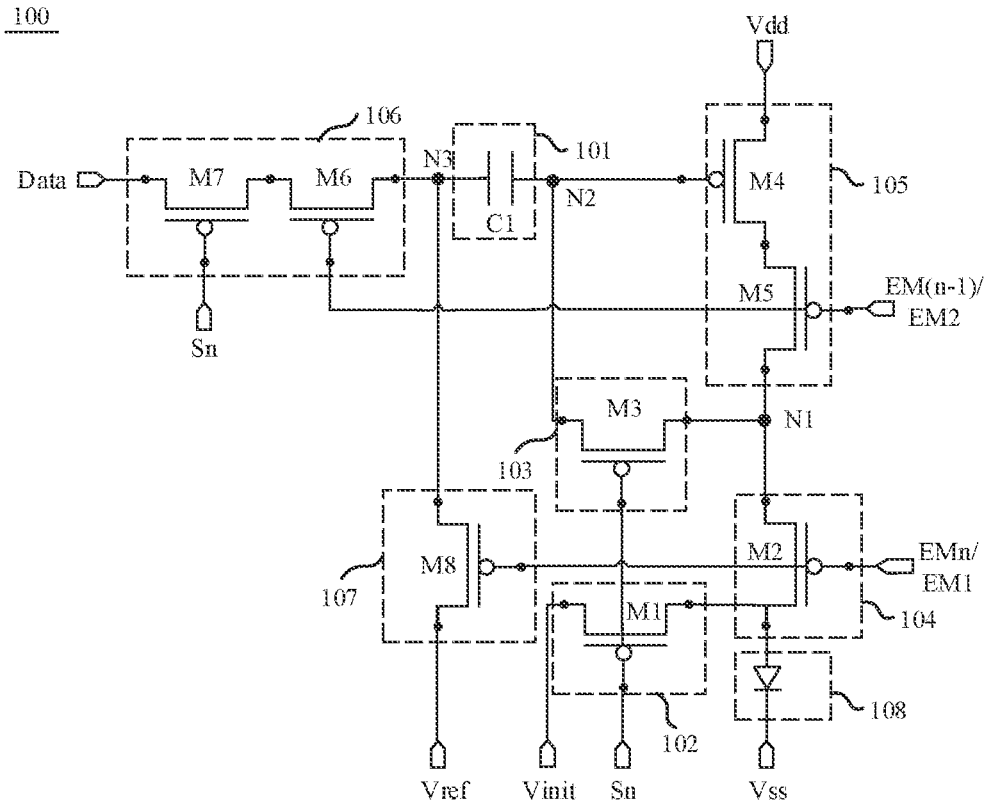
FIG. 8 is a structural diagram of still another pixel driving circuit, in accordance with some embodiments of the present disclosure.

In some examples, as shown in FIGS. 5 and 8, a control electrode of the fourth transistor M4 is coupled to the second node N2, a first electrode of the fourth transistor M4 is coupled to the first voltage signal terminal Vdd, and a second electrode of the fourth transistor M4 is coupled to a first electrode of the fifth transistor M5. A control electrode of the fifth transistor M5 is coupled to the second light-emitting timing signal terminal EM2, and a second electrode of the fifth transistor M5 is coupled to the first node N1. The fourth transistor M4 is configured to be turned on under the control of the voltage of the second node N2 to transmit the first voltage signal vdd received from the first voltage signal terminal Vdd to the first electrode of the fifth transistor M5, and generate and output a driving current according to the first voltage signal vdd. The fifth transistor M5 is configured to be turned on under the control of the second light-emitting timing signal em2 to transmit the driving current to the first node N1.

Figure 6:
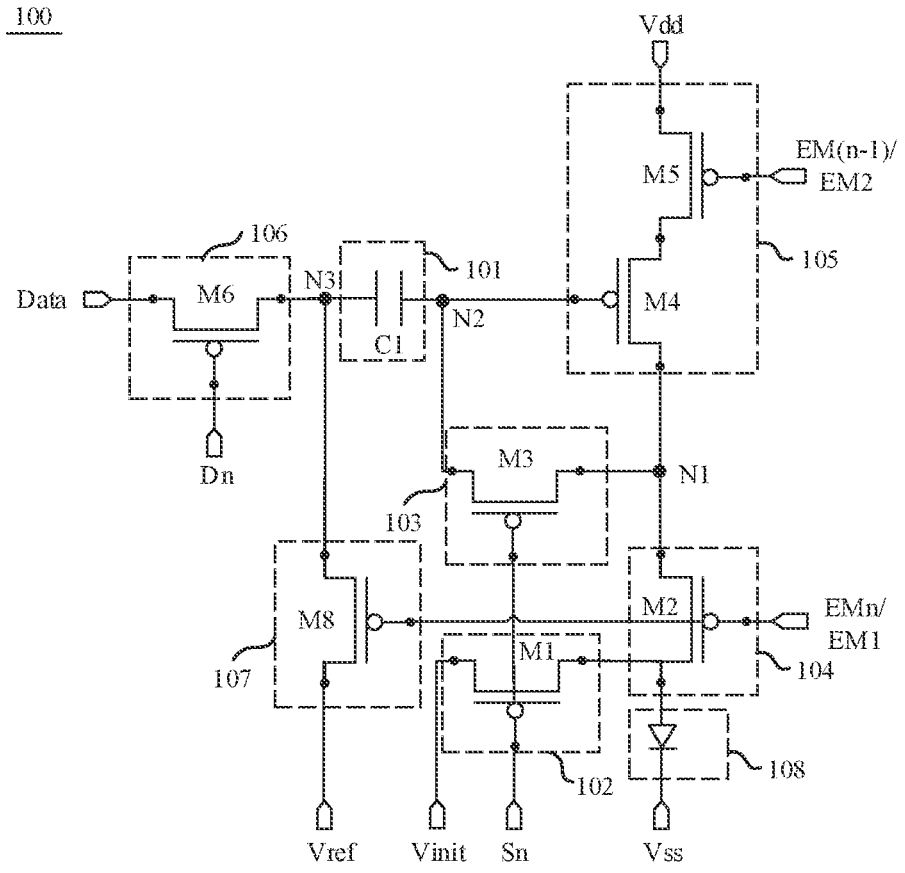
FIG. 6 is a structural diagram of still another pixel driving circuit, in accordance with some embodiments of the present disclosure.
Figure 9:
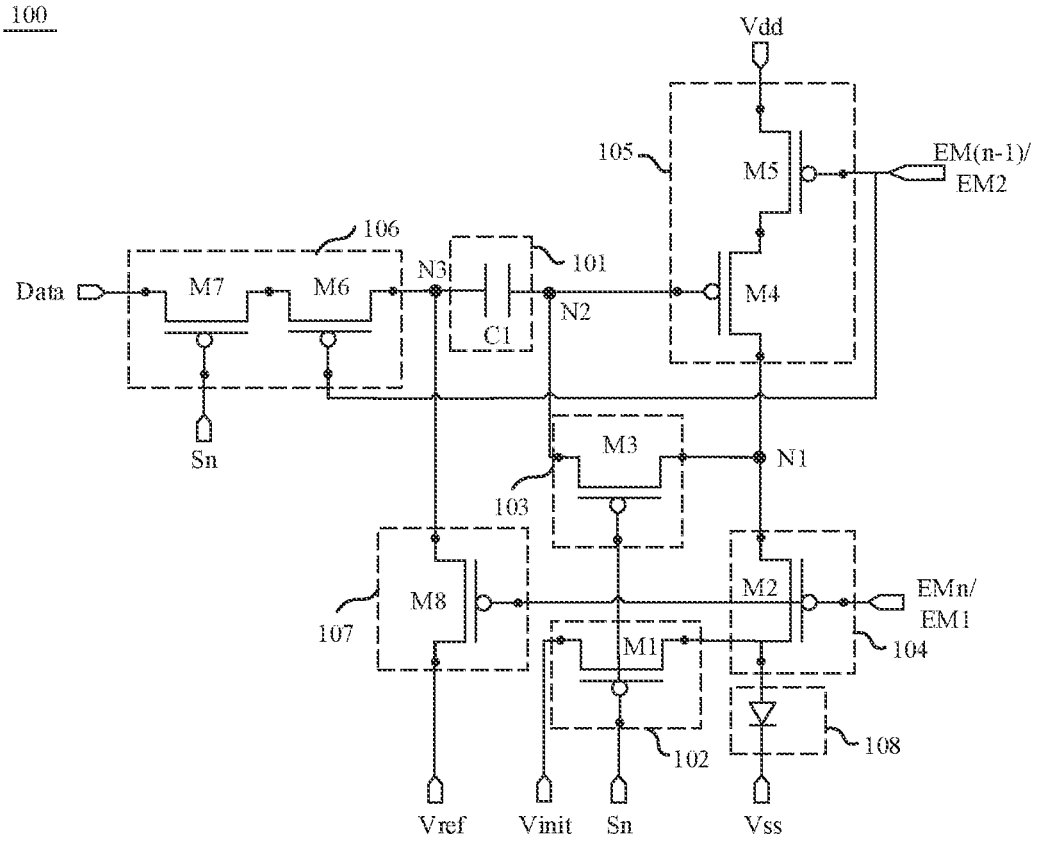
FIG. 9 is a structural diagram of a still another pixel driving circuit, in accordance with some embodiments of the present disclosure.

In some other examples, as shown in FIGS. 6 and 9, the control electrode of the fourth transistor M4 is coupled to the second node N2, the first electrode of the fourth transistor M4 is coupled to the second electrode of the fifth transistor M5, and the second electrode of the fourth transistor M4 is coupled to the first node N1. The control electrode of the fifth transistor M5 is coupled to the second light-emitting timing signal terminal EM2, and the first electrode of the fifth transistor M5 is coupled to the first voltage signal terminal Vdd. The fifth transistor M5 is configured to be turned on under the control of the second light-emitting timing signal em2 to transmit the first voltage signal vdd to the first electrode of the fourth transistor M4. The fourth transistor M4 is configured to be turned on under the control of a voltage of the second node N2, and generate and output the driving current according to the received first voltage signal vdd.

In some examples, as shown in FIGS. 5 and 6, in a case where the data writing sub-circuit 106 is coupled to the third node N3, the input control signal terminal Dn and the data signal terminal Data, the data writing sub-circuit 106 includes a sixth transistor M6. A control electrode of the sixth transistor M6 is coupled to the input control signal terminal Dn, a first electrode of the sixth transistor M6 is coupled to the data signal terminal Data, and a second electrode of the sixth transistor M6 is coupled to the third node N3. The sixth transistor M6 is configured to transmit the data signal data received from the data signal terminal Data to the third node N3 in response to the input control signal dn received from the input control signal terminal Dn.

In some other examples, as shown in FIGS. 8 and 9, in a case where the data writing sub-circuit 106 is coupled to the third node N3, the second light-emitting timing signal terminal EM2, the scanning timing signal terminal Sn and the data signal terminal Data, the data writing sub-circuit 106 includes the sixth transistor M6 and a seventh transistor M7. The control electrode of the sixth transistor M6 is coupled to the second light-emitting timing signal terminal EM2, the first electrode of the sixth transistor M6 is coupled to a second electrode of the seventh transistor M7, and the second electrode of the sixth transistor M6 is coupled to the third node N3. A control electrode of the seventh transistor M7 is coupled to the scanning timing signal terminal Sn, and a first electrode of the seventh transistor M7 is coupled to the data signal data.

The seventh transistor M7 is configured to transmit the data signal data received from the data signal terminal Data to the first electrode of the sixth transistor M6 in response to the scanning timing signal sn received from the scanning timing signal terminal Sn. The sixth transistor M6 is configured to transmit the data signal data to the third node N3 in response to the second light-emitting timing signal em2 received from the second light-emitting timing signal terminal EM2.

It will be noted that, in embodiments of the present disclosure, specific implementation manners of the storage sub-circuit 101, the reset sub-circuit 102, the compensation sub-circuit 103, the light-emitting control sub-circuit 104, the driving sub-circuit 105, the data writing sub-circuit 106 and the reference voltage sub-circuit 107 are not limited to the manners described above, but may be any implementation manners such as conventional connection manners that are well known to those skilled in the art, as long as functions corresponding thereto are ensured. The above examples are not intended to limit the protection scope of the present disclosure. In practical applications, those skilled in the art may choose to use or not to use one or more of the above circuits according to the situations, and variations based on various combinations of the above circuits do not depart from the principle of the present disclosure, which will not be described in detail herein.

On this basis, an overall exemplary introduction to a specific structure of the pixel driving circuit 100 provided in some embodiments of the present disclosure is to be given below.

As shown in FIGS. 5, 6, 8 and 9, the pixel driving circuit 100 includes the storage sub-circuit 101, the reset sub-circuit 102, the compensation sub-circuit 103, the light-emitting control sub-circuit 104, the driving sub-circuit 105 and the data writing sub-circuit 106 and the reference voltage sub-circuit 107.

The reset sub-circuit 102 includes the first transistor M1. The light-emitting control sub-circuit 104 includes the second transistor M2. The compensation sub-circuit 103 includes the third transistor M3. The driving sub-circuit 105 includes the fourth transistor M4 and the fifth transistor M5. The storage sub-circuit 101 includes the first capacitor C. The data writing sub-circuit 106 includes the sixth transistor M6; alternatively, the data writing sub-circuit 106 includes the sixth transistor M6 and the seventh transistor M7. The reference voltage sub-circuit 107 includes the eighth transistor M8.

The first electrode of the first capacitor C is coupled to the third node N3, and the second electrode of the first capacitor C is coupled to the second node N2. The first capacitor C is configured to be charged due to the action of the voltages of the third node N3 and the second node N2, perform coupling on the voltage of the second node N2 according to the voltage of the third node N3 to change the voltage of the second node N2, and maintain the voltage of the second node N2.

The control electrode of the first transistor M1 is coupled to the scanning timing signal terminal Sn, the first electrode of the first transistor M1 is coupled to the initialization signal terminal Vinit, and the second electrode of the first transistor M1 is coupled to the second electrode of the second transistor M2. The second electrode of the first transistor M1 is further coupled to the light-emitting device 108. The first transistor M1 is configured to: in response to the scanning timing signal sn received from the scanning timing signal terminal Sn, transmit the initialization signal vinit received from the initialization signal terminal Vinit to the second transistor M2, and transmit the initialization signal vinit to the light-emitting device 108, so as to reset the light-emitting device 108.

The control electrode of the second transistor M2 is coupled to the first light-emitting timing signal terminal EM1, the first electrode of the second transistor M2 is coupled to the first node N1, and the second electrode of the second transistor M2 is coupled to the second electrode of the first transistor M1 and the light-emitting device 108. The second transistor M2 is configured to: transmit the initialization signal vinit from the first transistor M1 to the first node N1 in response to the first light-emitting timing signal em1 received from the first light-emitting timing signal terminal EM1 in the reset stage, and transmit the driving signal from the first node N1 to the light-emitting device 108 in response to the first light-emitting timing signal em1 received from the first light-emitting timing signal terminal EM1 in the light-emitting stage.

For example, the light-emitting device 108 is a light-emitting diode. The second electrode of the first transistor M1 and the second electrode of the second transistor M2 are coupled to an anode of the light-emitting diode, and a cathode of the light-emitting diode is coupled to a second voltage signal terminal Vss.

The control electrode of the third transistor M3 is coupled to the scanning timing signal terminal Sn, the first electrode of the third transistor M3 is coupled to the first node N1, and the second electrode of the third transistor M3 is coupled to the second node N2. The third transistor M3 is configured to: transmit the initialization signal vinit from the first node N1 to the second node N2 in response to the scanning timing signal sn received from the scanning timing signal terminal Sn in the reset stage to reset the second node N2, and be turned on under the control of the scanning timing signal sn in the input and compensation stage, so as to make the driving sub-circuit 105 generate the self-saturation effect to generate the compensation signal.

In some examples, as shown in FIGS. 5 and 8, the control electrode of the fourth transistor M4 is coupled to the second node N2, the first electrode of the fourth transistor M4 is coupled to the first voltage signal terminal Vdd, and the second electrode of the fourth transistor M4 is coupled to the first electrode of the fifth transistor M5. The control electrode of the fifth transistor M5 is coupled to the second light-emitting timing signal terminal EM2, and the second electrode of the fifth transistor M5 is coupled to the first node N1.

The fourth transistor M4 is configured to: be turned on under the control of the voltage of the second node N2 to transmit the first voltage signal vdd received from the first voltage signal terminal Vdd to the first electrode of the fifth transistor M5, generate and output the driving current according to the first voltage signal vdd, and be turned on under the control of the second light-emitting timing signal em2 to transmit the driving current to the first node N1.

In some other examples, as shown in FIGS. 6 and 9, the control electrode of the fourth transistor M4 is coupled to the second node N2, the first electrode of the fourth transistor M4 is coupled to the second electrode of the fifth transistor M5, and the second electrode of the fourth transistor M4 is coupled to the first node N1. The control electrode of the fifth transistor M5 is coupled to the second light-emitting timing signal terminal EM2, and the first electrode of the fifth transistor M5 is coupled to the first voltage signal terminal Vdd.

The fifth transistor M5 is configured to be turned on under the control of the second light-emitting timing signal em2 to transmit the first voltage signal vdd to the first electrode of the fourth transistor M4. The fourth transistor M4 is configured to be turned on under the control of a voltage of the second node N2, and generate and output the driving current according to the received first voltage signal vdd.

As shown in FIGS. 5 and 6, in a case where the data writing sub-circuit 106 includes the sixth transistor M6, the control electrode of the sixth transistor M6 is coupled to the input control signal terminal Dn, the first electrode of the sixth transistor M6 is coupled to the data signal terminal Data, and the second electrode of the sixth transistor M6 is coupled to the third node N3. The sixth transistor M6 is configured to transmit the data signal data received from the data signal terminal Data to the third node N3 in response to the input control signal dn received from the input control signal terminal Dn.

As shown in FIGS. 8 and 9, in a case where the data writing sub-circuit 106 includes the sixth transistor M6 and the seventh transistor M7, the control electrode of the sixth transistor M6 is coupled to the second light-emitting timing signal terminal EM2, the first electrode of the sixth transistor M6 is coupled to the second electrode of the seventh transistor M7, and the second electrode of the sixth transistor M6 is coupled to the third node N3. The control electrode of the seventh transistor M7 is coupled to the scanning timing signal terminal Sn, and the first electrode of the seventh transistor M7 is coupled to the data signal terminal Data.

The seventh transistor M7 is configured to transmit the data signal data received from the data signal terminal Data to the first electrode of the sixth transistor M6 in response to the scanning timing signal sn received from the scanning timing signal terminal Sn. The sixth transistor M6 is configured to transmit the data signal data to the third node N3 in response to the second light-emitting timing signal em2 received from the second light-emitting timing signal terminal EM2.

The control electrode of the eighth transistor M8 is coupled to the first light-emitting timing signal terminal EM1, the first electrode of the eighth transistor M8 is coupled to the reference voltage terminal Vref, and the second electrode of the eighth transistor M8 is coupled to the third node N3. The eighth transistor M8 is configured to transmit the reference voltage signal vref received from the reference voltage signal terminal Vref to the third node N3 in response to the first light-emitting timing signal em1 received from the first light-emitting timing signal terminal EM1.

The transistors used in the pixel driving circuit 100 provided in the embodiments of the present disclosure may be thin film transistors, field effect transistors or other switching devices with the same characteristics. Embodiments of the present disclosure are all described by taking the thin film transistors as examples.

In some embodiments, a control electrode of each transistor used in the pixel driving circuit 100 is a gate of the transistor, a first electrode of each transistor is one of a source and a drain of the transistor, and a second electrode of each transistor is the other one of the source and the drain of the transistor. Since a source and a drain of a transistor may be symmetrical in structure, the source and the drain thereof may be indistinguishable in structure. That is to say, a first electrode and a second electrode of a transistor in the embodiments of the present disclosure may be indistinguishable in structure. For example, in a case where the transistor is a P-type transistor, the first electrode of the transistor is the source, and the second electrode of the transistor is the drain. For example, in a case where the transistor is an N-type transistor, the first electrode of the transistor is the drain, and the second electrode of the transistor is the source.

In addition, the pixel driving circuit 100 provided in the embodiments of the present disclosure is described by taking an example in which the transistors are all P-type transistors. A pixel driving method to be provided below is also described by taking P-type transistors as examples. It will be noted that the embodiments of the present disclosure include but are not limited thereto. For example, one or more transistors in the circuit provided in the embodiments of the present disclosure may adopt N-type transistors, as long as electrodes of transistors of the selected type with reference to the electrodes of corresponding transistors in the embodiments of the present disclosure, and corresponding voltage terminals provide corresponding high voltages or corresponding low voltages.

In the circuit provided in the embodiments of the present disclosure, the first node, the second node and the third node do not represent actual components, but rather represent junctions of related electrical connections in a circuit diagram. That is, these nodes are nodes equivalent to the junctions of the related electrical connections in the circuit diagram.

Some embodiments of the present disclosure provide a pixel driving method, which is applied to the pixel driving circuit 100 provided in the embodiments of the present disclosure. Considering FIGS. 3 and 4 as an example, the pixel driving circuit 100 includes the storage sub-circuit 101, the reset sub-circuit 102, the compensation sub-circuit 103, the light-emitting control sub-circuit 104, the driving sub-circuit 105, the data writing sub-circuit 106 and the reference voltage sub-circuit 107; the reset sub-circuit 102 is coupled to the light-emitting control sub-circuit 104, the scanning timing signal terminal Sn and the initialization signal terminal Vinit; the storage sub-circuit 101 is coupled to the second node N2 and the third node N3; the data writing sub-circuit 106 is coupled to the third node N3, the input control signal terminal Dn and the data signal terminal Data, or the data writing sub-circuit 106 is coupled to the third node N3, the scanning timing signal terminal Sn, the second light-emitting timing signal terminal EM2 and the data signal terminal Data; the reference voltage sub-circuit 107 is coupled to the third node N3, the first light-emitting timing signal terminal EM1 and the reference voltage signal terminal Vref; and the reset sub-circuit 102 and the light-emitting control sub-circuit 104 are further coupled to the light-emitting device 108. As shown in FIGS. 7 and 10, the pixel driving method includes the following steps. A frame period includes a reset stage P1, an input and compensation stage P2 and a light-emitting stage P3.

In the reset stage P1, the following steps are performed by respective sub-circuits.

The reference voltage sub-circuit 107 transmits a reference voltage signal vref received from the reference voltage signal terminal Vref to the third node N3 in response to a first light-emitting timing signal em1 received from the first light-emitting timing signal terminal EM1.

The reset sub-circuit 102, in response to a scanning timing signal sn received from the scanning timing signal terminal Sn, transmits an initialization signal vinit received from the initialization signal terminal Vinit to the light-emitting control sub-circuit 104, and transmits the initialization signal vinit to the light-emitting device 108 to reset the light-emitting device 108.

The light-emitting control sub-circuit 104 transmits the initialization signal vinit to the first node N1 in response to the first light-emitting timing signal em1 received from the first light-emitting timing signal terminal EM1.

The compensation sub-circuit 103 transmits the initialization signal vinit from the first node N1 to the second node N2 under the control of the scanning timing signal sn, so as to reset a voltage of the second node N2.

The driving sub-circuit 105 opens a conductive path from the first voltage signal terminal Vdd to the initialization signal terminal Vinit in response to a second light-emitting timing signal em2 received from the second light-emitting timing signal terminal EM2.

For example, as shown in FIGS. 5, 6, 8 and 9, the reset sub-circuit 102 includes the first transistor M1; the light-emitting control sub-circuit 104 includes the second transistor M2; and the compensation sub-circuit 103 includes the third transistor M3; the driving sub-circuit 105 includes the fourth transistor M4 and the fifth transistor M5; the storage sub-circuit 101 includes the first capacitor C; the data writing sub-circuit 106 includes the sixth transistor M6, alternatively, the data writing sub-circuit 106 includes the sixth transistor M6 and the seventh transistor M7; the reference voltage sub-circuit 107 includes the eighth transistor M8; and the light-emitting device 108 includes a light-emitting diode. In this case, in the reset stage P1, the following steps are performed by respective sub-circuits.

The eighth transistor M8 is turned on under the control of the first light-emitting timing signal em1 to transmit the reference voltage signal vref to the third node N3. A voltage of the third node N3 is a voltage $V_{ref}$ of the reference voltage signal vref. The first transistor M1 is turned on under the control of the scanning timing signal sn to transmit the initialization signal vinit to the second electrode of the second transistor M2 and the anode of the light-emitting diode. The second transistor M2 is turned on under the control of the first light-emitting timing signal em1 to transmit the initialization signal vinit from the first transistor M1 to the first node N1. The third transistor M3 is turned on under the control of the scanning timing signal sn to transmit the initialization signal vinit from the first node N1 to the second node N2. The voltage of the second node N2 is a voltage $V_{init}$ of the initialization signal vinit. In this way, the voltage of the second node N2 is reset, thereby realizing a reset of the second end (the signal holding end) of the storage sub-circuit 101.

The fourth transistor M4 is in a linear conduction state under the control of the voltage of the second node N2. The fifth transistor M5 is turned off under the control of the second light-emitting timing signal em2, which may open the conductive path from the first voltage signal terminal Vdd to the initialization signal terminal Vinit, thereby avoiding an ineffective power consumption.

Figure 10:
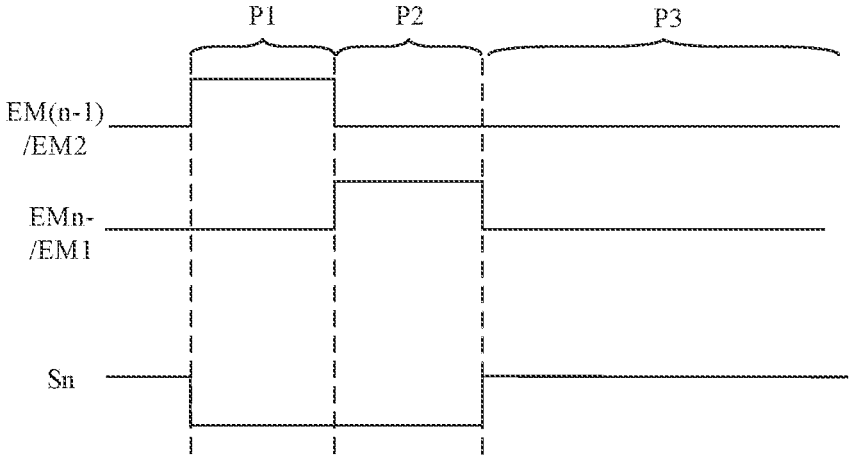
FIG. 10 is a timing diagram corresponding to the pixel driving circuits in FIGS. 4, 8 and 9.

With reference to FIGS. 8 to 10, in a case where the data writing sub-circuit 106 includes the sixth transistor M6 and the seventh transistor M7, the seventh transistor M7 is turned on under the control of the scanning timing signal sn, and the sixth transistor M6 is turned off under the control of the second light-emitting timing signal em2. Therefore, a data signal data cannot be transmitted to the third node N3. In this way, writing of the data signal data will not occupy a time for resetting, which may ensure that the third node N3 is fully reset.

With continued reference to FIGS. 3, 4, 7 and 10, in the input and compensation stage P2, the following steps are performed by respective sub-circuits.

The reset sub-circuit 102 transmits the initialization signal vinit received from the initialization signal terminal Vinit to the light-emitting device 108 in response to the scanning timing signal sn received from the scanning timing signal terminal Sn, so as to continuously reset the light-emitting device 108.

As shown in FIG. 3, in a case where the data writing sub-circuit 106 is coupled to the third node N3, the input control signal terminal Dn and the data signal terminal Data, the data writing sub-circuit 106 transmits the data signal data received from the data signal terminal Data to the third node N3 in response to an input control signal dn received from the input control signal terminal Dn.

As shown in FIG. 4, in a case where the input control signal terminal Dn is the second light-emitting timing signal terminal EM2, and the data writing sub-circuit 106 is further coupled to the scanning timing signal terminal Sn, the data writing sub-circuit 106 transmits the data signal data received from the data signal terminal Data to the third node N3 in response to the second light-emitting timing signal em2 received from the second light-emitting timing signal terminal EM2 and the scanning timing signal sn received from the scanning timing signal terminal Sn.

The compensation sub-circuit 103 brings the driving sub-circuit 105 into a self-saturation state under the control of the scanning timing signal sn.

The driving sub-circuit 105 reaches the self-saturation state in response to the second light-emitting timing signal em2 and due to action of the compensation sub-circuit 103 to generate a compensation signal according to the first voltage signal vdd received from the first voltage signal terminal Vdd, and transmits the compensation signal to the second node N2.

The storage sub-circuit 101 is charged due to action of voltages of the second node N2 and the third node N3.

For example, as shown in FIGS. 5, 6, 8 and 9, the reset sub-circuit 102 includes the first transistor M1; the light-emitting control sub-circuit 104 includes the second transistor M2; the compensation sub-circuit 103 includes the third transistor M3; the driving sub-circuit 105 includes the fourth transistor M4 and the fifth transistor M5; the storage sub-circuit 101 includes the first capacitor C; the data writing sub-circuit 106 includes the sixth transistor M6, alternatively, the data writing sub-circuit 106 includes the sixth transistor M6 and the seventh transistor M7; the reference voltage sub-circuit 107 includes the eighth transistor M8, and the light-emitting device 108 is a light-emitting diode. In this case, in the input and compensation stage P2, the following steps are performed by respective sub-circuits.

As shown in FIGS. 5 and 6, in a case where the data writing sub-circuit 106 includes the sixth transistor M6, the sixth transistor M6 is turned on to transmit the data signal data to the third node N3 under the control of the input control signal dn.

As shown in FIGS. 8 and 9, in a case where the data writing sub-circuit 106 includes the sixth transistor M6 and the seventh transistor M7, the seventh transistor M7 is turned on under the control of the scanning timing signal sn to transmit the data signal data to the first electrode of the sixth transistor M6; and the sixth transistor M6 is turned on under the control of the second light-emitting timing signal em2 to transmit the data signal data to the third node N3. In this case, a voltage of the third node N3 is a voltage $V_{data}$ of the data signal data. Therefore, the voltage $V_{data}$ of the data signal data is stored in the first capacitor C.

As shown in FIGS. 5 and 8, the fourth transistor M4 is turned on under the control of the voltage of the second node N2, the fifth transistor M5 is turned on under the control of the second light-emitting timing signal em2, and the third transistor M3 is turned on under the control of the scanning timing signal sn. In this case, the third transistor M3 and the fifth transistor M5 couple the control electrode of the fourth transistor M4 to the second electrode of the fourth transistor M4, so the fourth transistor M4 reaches a self-saturation state where a voltage of the control electrode of the fourth transistor M4 is a sum of a voltage of the first electrode thereof and a threshold voltage $V_{th}$ thereof. Since the first electrode of the fourth transistor M4 is coupled to the first voltage signal terminal Vdd, a voltage of the first electrode of the fourth transistor M4 is a voltage $V_{dd}$ of the first voltage signal vdd. Therefore, the voltage of the control electrode of the fourth transistor M4 is equal to $V_{dd}+V_{th}$. Since the second node N2 is coupled to the control electrode of the fourth transistor M4, the voltage of the second node N2 is also equal to $V_{dd}+V_{th}$. In this way, the sum ($V_{dd}+V_{th}$) of the first voltage signal vdd and the threshold voltage is stored in the first capacitor C, which achieves writing of the threshold voltage $V_{th}$ of the driving transistor.

As shown in FIGS. 6 and 9, the fourth transistor M4 is turned on under the control of the voltage of the second node N2, the fifth transistor M5 is turned on under the control of the second light-emitting timing signal em2, and the third transistor M3 is turned on under the control of the scanning timing signal sn. In this case, the third transistor M3 couples the control electrode of the fourth transistor M4 to the second electrode of the fourth transistor M4, so the fourth transistor M4 reaches the self-saturation state where the voltage of the control electrode of the fourth transistor M4 is the sum of the voltage of the first electrode thereof and the threshold voltage $V_{th}$ thereof. The fifth transistor M5 transmits the first voltage signal vdd to the first electrode of the fourth transistor M4, so that a voltage of the first electrode of the fourth transistor M4 is the voltage Vdd of the first voltage signal vdd. Therefore, the voltage of the control electrode of the fourth transistor M4 is equal to $V_{dd}+V_{th}$. The second node N2 is coupled to the control electrode of the fourth transistor M4, so the voltage of the second node N2 is also equal to $V_{dd}+V_{th}$, and then the sum ($V_{dd}+V_{th}$) of the first voltage signal vdd and the threshold voltage $V_{th}$ is stored in the first capacitor C, which achieves the writing of the threshold voltage $V_{th}$ of the driving transistor.

The first transistor M1 is turned on under the control of the scanning timing signal sn to transmit the initialization signal vinit to the anode of the light-emitting diode, so as to continuously reset the anode of the light-emitting diode.

The second transistor M2 and the eighth transistor M8 are both turned off in the input and compensation stage.

With continued reference to FIGS. 3, 4, 7 and 10, in the light-emitting stage P3, the following steps are performed by respective sub-circuits.

The reference voltage sub-circuit 107 transmits the reference voltage signal vref received from the reference voltage signal terminal Vref to the third node N3 in response to the first light-emitting timing signal em1 received from the first light-emitting timing signal terminal EM1.

The storage sub-circuit 101 performs coupling on a voltage of the second node N2 to change the voltage of the second node N2 due to action of the voltage of the third node N3, and maintains the voltage of the second node N2.

The driving sub-circuit 105 generates a driving signal according to the first voltage signal vdd in response to the second light-emitting timing signal em2 and due to coupling action of the storage sub-circuit 101, and transmits the driving signal to the light-emitting control sub-circuit 104.

The light-emitting control sub-circuit 104 transmits the driving signal from the driving sub-circuit 105 to the light-emitting device 108 in response to the first light-emitting timing signal em1, so as to drive the light-emitting device 108 to emit light.

For example, as shown in FIGS. 5, 6, 8 and 9, the reset sub-circuit 102 includes the first transistor M1; the light-emitting control sub-circuit 104 includes the second transistor M2; the compensation sub-circuit 103 includes the third transistor M3; the driving sub-circuit 105 includes the fourth transistor M4 and the fifth transistor M5; the storage sub-circuit 101 includes the first capacitor C; the data writing sub-circuit 106 includes the sixth transistor M6, alternatively, the data writing sub-circuit 106 includes the sixth transistor M6 and the seventh transistor M7; the reference voltage sub-circuit 107 includes the eighth transistor M8; and the light-emitting device 108 is a light-emitting diode. In this case, in the light-emitting stage P3, the following steps are performed by respective sub-circuits.

The eighth transistor M8 is turned on under the control of the first light-emitting timing signal em1 to transmit the reference voltage signal vref to the third node N3. The voltage of the third node N3 becomes the voltage $V_{ref}$ of the reference voltage.

According to the principle of charge retention in capacitors, since the voltage of the third node N3 changes from the voltage $V_{data}$ of the data signal data to the voltage $V_{ref}$. That is, a voltage of the first end of the first capacitor C changes from $V_{data}$ to $V_{ref}$, and a voltage of the second end of the first capacitor C will change by a same amount, i.e., will jump from $V_{dd}+V_{th}$ to $V_{dd}+V_{th}+V_{ref}-V_{data}$. The voltage of the second node N2 is equal to $V_{dd}+V_{th}+V_{ref}-V_{data}$.

The fourth transistor M4 is turned on under the control of the voltage of the second node N2. The fifth transistor M5 is turned on under the control of the second light-emitting timing signal em2. The fourth transistor M4 generates the driving signal according to the first voltage signal vdd, and outputs the driving signal.

The second transistor M2 is turned on under the control of the first light-emitting timing signal em1 to transmit the received driving signal to the light-emitting diode, so that the light-emitting diode emits light.

For example, the drive signal is a driving current. According to the calculation formula of the driving current $I_{ds}$, the driving current $I_{ds}$ satisfies:

$$I_{ds} = \frac{W}{2L} \times \mu \times C_{ox}(V_{gs} - V_{th})^2$$

$$= \frac{W}{2L} \times \mu \times C_{ox}(V_{dd} + V_{th} + V_{ref} - V_{data} - V_{dd} - V_{th})^2,$$

$$= \frac{W}{2L} \times \mu \times C_{ox}(V_{ref} - V_{data})^2$$

where $I_{ds}$ is a saturation current of the fourth transistor M4, i.e., a driving current input into the light-emitting diode, W/L is a width-to-length ratio of a channel of the fourth transistor M4, μ is a carrier mobility, $C_{ox}$ is a channel capacitance per unit area of the fourth transistor M4, $V_{gs}$ is a gate-source voltage difference of the fourth transistor M4, and $V_{th}$ is a threshold voltage of the fourth transistor M4.

It will be seen that, a magnitude of the driving current generated by the fourth transistor M4 is only related to the reference voltage signal vref and the data signal data, and is not related to the threshold voltage of the fourth transistor M4. Therefore, the magnitude of the driving current generated by the fourth transistor M4 is not affected by the threshold voltage of the fourth transistor M4. As a result, a problem of different magnitudes of driving currents, which is caused by different threshold voltages of fourth transistors M4 in pixel driving circuits 100 due to manufacturing processes and will affect display effects, may be avoided. Therefore, a uniformity of light-emitting brightnesses of light-emitting devices 108 is improved.

In the light-emitting stage P3, the first transistor M1, the third transistor M3 and the sixth transistor M6 (or the sixth transistor M6 and the seventh transistor M7) are all turned off.

In the pixel driving circuit 100 provided in the embodiments of the present disclosure, there is only a single electric leakage path from the second node N2 to the first node N1 through the third transistor M3 in the light-emitting stage P3, thereby reducing the electric leakage of the second node N2 significantly, and then improving the voltage holding ratio of the first capacitor C. Therefore, the fourth transistor M4 may generate a stable driving current under the control of the voltage of the second node N2 in the light-emitting stage, which avoids an excessive change in the driving current due to an excessive change in the voltage of the second node N2. As a result, the stability of the light-emitting brightness of the light-emitting device 108 may be improved.

Some embodiments of the present disclosure provide a display panel 01. As described above, the display panel 01 includes: the plurality of sub-pixels 10, the plurality of scanning timing signal lines GL, the plurality of light-emitting timing signal lines EL and the plurality of data signal lines DL. A sub-pixel 10 is provided therein with a pixel driving circuit 100 as provided in the embodiments of the present disclosure.

Figure 11:
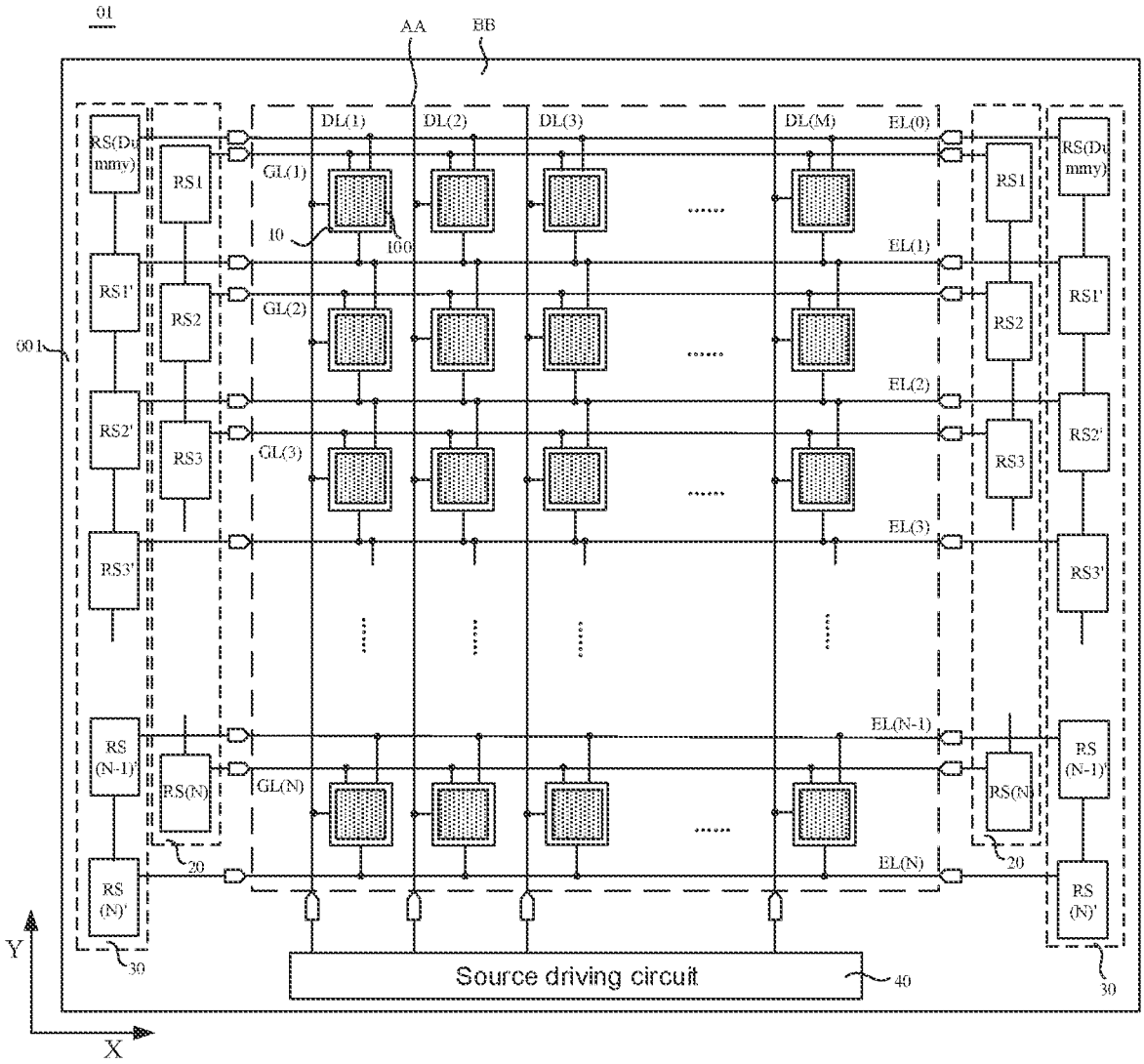
FIG. 11 is a structural diagram of a display panel, in accordance with some embodiments of the present disclosure.

For example, as shown in FIG. 11, the plurality of sub-pixels P are arranged in the N rows and M columns. The scanning timing signal lines GL include N scanning timing signal lines GL, which are GL(1) to GL(N), respectively. The light-emitting timing signal lines EL include N light-emitting timing signal lines EL, which are EL(1) to EL(N), respectively. The data signal lines DL include M data signal lines DL, which are DL(1) to DL(M), respectively. N and M are both positive integers.

Scanning timing signal terminals Sn of pixel driving circuits 100 included in an nth row of sub-pixels 10 are coupled to an nth scanning timing signal line GL(n). For example, scanning timing signal terminals Sn of pixel driving circuits 100 included in a first row of sub-pixels 10 are coupled to a first scanning timing signal line GL(1), and scanning timing signal terminals Sn of pixel driving circuits 100 included in an Nth row of sub-pixels 10 are coupled to an Nth scanning timing signal line GL(N), where n is greater than or equal to 1 and less than or equal to N ($1 \le n \le N$).

First light-emitting timing signal terminals EM1 of the pixel driving circuits 100 included in the nth row of sub-pixels 10 are coupled to an nth light-emitting timing signal line EL(n). Other than the first row of sub-pixels, second light-emitting timing signal terminals EM2 of the pixel driving circuits 100 in the nth row of sub-pixels are coupled to an (n−1)th light-emitting timing signal line EL(n−1). For example, first light-emitting timing signal terminals EM1 of pixel driving circuits 100 included in a second row of sub-pixels 10 are coupled to a second light-emitting timing signal line EL(2), and second light-emitting timing signal terminals EM2 of the pixel driving circuits 100 included in the second row of sub-pixels 10 are coupled to a first light-emitting timing signal line EL(1), where n is greater than or equal to 1 and less than or equal to N (1≤n≤N).

In some embodiments, the display panel 01 further includes at least one row of dummy cells disposed in front of the first row of sub-pixels and behind a last row of sub-pixels (the Nth row of sub-pixels). The at least one row of dummy cells has a same structure as the above sub-pixels, but do not have corresponding functions when the display panel performs display. Due to process factors and circuit parasitic parameters, among the N rows of sub-pixels actually used for display, pixel driving circuits 100 in edge sub-pixels (the first row of sub-pixels and the nth row of sub-pixels) are different from pixel driving circuits 100 in middle sub-pixels in electrical characteristics. By providing the at least one row of dummy cells and using the at least one row of dummy cells as an edge row, it is possible to avoid differences between edge sub-pixels and middle sub-pixels of the N rows of sub-pixels actually used for display, which ensures a normal display.

Therefore, as for the at least one row of dummy cells, in addition to the N scanning timing signal lines GL(1) to GL(N) and the N light-emitting timing signal lines EL(1) to EL(N), the display panel 01 further includes corresponding dummy lines. For example, the display panel 01 further includes a dummy scanning timing signal line GL(dummy) and a dummy light-emitting timing signal line EL(dummy). For example, as shown in FIG. 11, the display panel further includes the dummy light-emitting timing signal line EL(dummy) disposed in front of the first light-emitting timing signal line EL(1), which is, for example, referred to as a 0th light-emitting timing signal line EL(0).

In this way, first light-emitting timing signal terminals EM1 of the pixel driving circuits 100 included in the first row of sub-pixels 10 are coupled to the first light-emitting timing signal line E(1), and second light-emitting timing signal terminals EM2 of the pixel driving circuits 100 included in the first row of sub-pixels 10 are coupled to the 0th light-emitting timing signal line E(0). The 0th light-emitting timing signal line EL(0) is configured to transmit a second emission timing signal em2 to the second light-emitting timing signal terminals EM2 of the pixel driving circuits 100 included in the first row of sub-pixels 10.

For example, data signal terminals Data of pixel driving circuits 100 included in an mth column of sub-pixels are coupled to an mth data signal line. For example, as shown in FIG. 11, data signal terminals Data of pixel driving circuits 100 included in a first column of sub-pixels 10 are coupled to a first data signal line DL(1), and data signal terminals Data of pixel driving circuits 100 included in an Mth column of sub-pixels 10 are coupled to an Mth data signal line DL(M).

In this way, the scanning timing signal line GL provide the scanning timing signal sn for scanning timing signal terminals Sn, the light-emitting timing signal line EL provide the first light-emitting timing signal em1 for first light-emitting timing signal terminals EM1, and provide the second light-emitting timing signal em2 for second light-emitting timing signal terminals EM2, and the data signal line DL provide data signals data for data signal terminals Data.

It will be noted that, the above-described arrangement of the plurality of signal lines included in the display panel 01 and the wiring diagram of the display panel 01 shown in FIG. 11 are merely an example, which does not constitute a limitation on a structure of the display panel 01.

In addition, the display panel 01 further includes signal lines such as a plurality of reset signal lines, a plurality of initialization signal lines, and a plurality of first voltage signal lines, and the present disclosure does not limit a wiring manner thereof.

In some embodiments, as shown in FIG. 11, the display panel 01 further includes gate driving circuits 20, light-emitting driving circuits 30 and a source driving circuit 40 that are disposed in the peripheral area BB. In some embodiments, the gate driving circuits 20 and the light-emitting driving circuits 30 may be disposed in a periphery in an extending direction of the scanning timing signal lines GL, and the data driving circuit 40 may be disposed in a periphery in an extending direction of the data signal lines DL, so as to drive driving pixel circuits 100 of the display panel to display.

In some embodiments, the gate driving circuit 20 may be a gate driving integrated circuit (IC), the light-emitting driving circuit 30 may be a light-emitting driving IC, and the source driving circuit 40 may be a source driving IC.

In some other embodiments, the gate driving circuit 20 may be a gate driver on array (GOA) circuit, and the light-emitting driving circuit 30 may be an emission driver on array (EOA) circuit. That is, the gate driving circuit 20 and the light-emitting driving circuit 30 are directly integrated on an array substrate of the display panel 01. In this way, in one aspect, a manufacturing cost of the display panel may be reduced; and in another aspect, a frame width of the display apparatus may also be narrowed. The following description is made by taking an example in which the gate driving circuit 20 is the GOA circuit and the light-emitting driving circuit 30 is the EOA circuit.

It will noted that, in some examples, the display panel 01 is provided with a gate driving circuit 20 and a light-emitting driving circuit 30 on a single side of the active area AA, and the scanning timing signal lines GL and the light-emitting timing signal lines EL are driven row by row from the side. That is single-side driving.

In some other examples, as shown in FIG. 11, the display panel 01 is provided with two gate driving circuits 20 on two sides of the active area AA in a horizontal direction X, and the scanning timing signal lines GL are driven by the two gate driving circuits 20 row by row from both sides simultaneously; and the display panel 01 is provided with two light-emitting driving circuits 30 on the two sides in the horizontal direction X, and the light-emitting timing signal lines EL are driven row by the two light-emitting driving circuits 30 row by row from the both sides simultaneously. That is double-side driving.

The gate driving circuit 20 is configured to provide scanning timing signals sn. For example, the gate driving circuit 20 includes N stages of cascaded shift registers (RS1, RS2 . . . RS(N)). The N stages of cascaded shift registers (RS1, RS2 . . . RS(N)) are respectively coupled to the N scanning timing signal lines GL(1) to GL(N), and used for outputting respective scanning timing signals sn to the scanning timing signal lines.

The light-emitting driving circuit 30 is configured to provide light-emitting timing signals. For example, the light-emitting driving circuit 30 includes N stages of cascaded shift registers (RS1', RS2' . . . RS(N)'), and the N stages of cascaded shift registers (RS1', RS2' . . . RS(N)') are coupled to the N light-emitting timing signal lines EL(1) to EL(N), respectively. In a case where the display panel further includes the 0th light-emitting timing signal line EL(0), the light-emitting driving circuit 30 further includes a dummy shift register RS(dummy), and the dummy shift register RS is coupled to a first stage shift register RS1' and the 0th light-emitting timing signal line EL(0). That is, the light-emitting driving circuit 30 includes (N+1) stages of cascaded shift registers which are used for respective outputting light-emitting timing signals to the light-emitting timing signal lines EL.

Since the pixel driving circuit 100 provided in the present disclosure may improve the voltage holding ratio of the storage sub-circuit, the stability of the light-emitting brightness of the light-emitting device is improved, and the uniformity of the light-emitting brightnesses of the light-emitting devices is ensured. Therefore, the display panel 01 has good display effects with low flicker and uniform display brightness.

Figure 12:
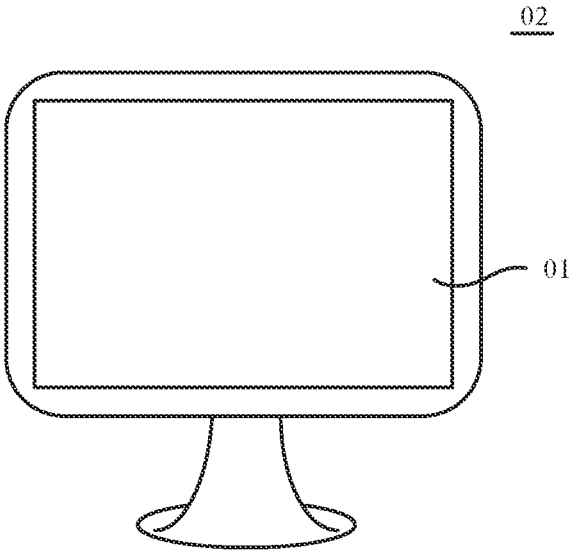
FIG. 12 is a structural diagram of a display apparatus, in accordance with some embodiments of the present disclosure.

Some embodiments of the present disclosure provide a display apparatus 02. As shown in FIG. 12, the display apparatus includes the display panel 01.

In some examples, the display apparatus further includes a frame, a circuit board, a display driver integrated circuit (IC) and other electronic components. The display panel 01 is disposed in the frame.

The display apparatus provided in the present disclosure may be any apparatus that displays images whether in motion (e.g., videos) or stationary (e.g., still images) and whether text or images. More specifically, it is anticipated that the embodiments may be implemented in a variety of electronic apparatuses or associated with a variety of electronic apparatuses. The variety of electronic apparatuses include (but are not limited to) a mobile phone, a wireless apparatus, a personal data assistant (PDA), a hand-held or portable computer, a GPS receiver/navigator, a camera, an MP4 video player, a video camera, a game console, a watch, a clock, a calculator, a television monitor, a flat panel display, a computer monitor, an automobile display (e.g., an odometer display), a navigator, a cockpit controller and/or display, a display of camera views (e.g., a display of a rear-view camera in a vehicle), an electronic photo, an electronic billboard or sign, a projector, a building structure, a packaging and aesthetic structure (e.g., a display for displaying an image of a piece of jewelry), etc.

The display apparatus 100 provided in the present disclosure has same beneficial effects as the display panel, which will not be repeated herein.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. A pixel driving circuit, comprising:

a reset sub-circuit, a compensation sub-circuit, a light-emitting control sub-circuit and a driving sub-circuit, wherein the reset sub-circuit is directly coupled to the light-emitting control sub-circuit, a scanning timing signal terminal and an initialization signal terminal;

the light-emitting control sub-circuit is further directly coupled to a first node and a first light-emitting timing signal terminal;

the compensation sub-circuit is directly coupled to the first node, a second node and the scanning timing signal terminal;

the driving sub-circuit is directly coupled to the first node, the second node, a first voltage signal terminal and a second light-emitting timing signal terminal;

the reset sub-circuit is coupled to the second node only through a path formed by the light-emitting control sub-circuit, the first node and the compensation sub-circuit;

the reset sub-circuit is configured to transmit an initialization signal received from the initialization signal terminal to the light-emitting control sub-circuit in response to a scanning timing signal received from the scanning timing signal terminal;

the light-emitting control sub-circuit is configured to transmit the initialization signal to the first node in response to a first light-emitting timing signal received from the first light-emitting timing signal terminal;

the compensation sub-circuit is configured to transmit the initialization signal from the first node to the second node under control of the scanning timing signal, so as to reset a voltage of the second node; and the driving sub-circuit is configured to open a conductive path from the first voltage signal terminal to the initialization signal terminal in response to a second light-emitting timing signal received from the second light-emitting timing signal terminal during a process of resetting the voltage of the second node.

2. The pixel driving circuit according to claim 1, wherein the reset sub-circuit includes a first transistor; a control electrode of the first transistor is directly coupled to the scanning timing signal terminal, a first electrode of the first transistor is directly coupled to the initialization signal terminal, and a second electrode of the first transistor is directly coupled to the light-emitting control sub-circuit;

the light-emitting control sub-circuit includes a second transistor;

a control electrode of the second transistor is directly coupled to the first light-emitting timing signal terminal, a first electrode of the second transistor is directly coupled to the first node, and a second electrode of the second transistor is directly coupled to the second electrode of the first transistor; and the compensation sub-circuit includes a third transistor;

a control electrode of the third transistor is directly coupled to the scanning timing signal terminal, a first electrode of the third transistor is directly coupled to the first node, and a second electrode of the third transistor is directly coupled to the second node.

3. The pixel driving circuit according to claim 1, wherein the driving sub-circuit includes a fourth transistor and a fifth transistor;

a control electrode of the fourth transistor is directly coupled to the second node, a first electrode of the fourth transistor is directly coupled to the first voltage signal terminal, and a second electrode of the fourth transistor is directly coupled to a first electrode of the fifth transistor;

a control electrode of the fifth transistor is directly coupled to the second light-emitting timing signal terminal, and a second electrode of the fifth transistor is directly coupled to the first node.

4. The pixel driving circuit according to claim 1, wherein the driving sub-circuit includes a fourth transistor and a fifth transistor;

a control electrode of the fourth transistor is directly coupled to the second node, a first electrode of the fourth transistor is directly coupled to a second electrode of the fifth transistor, and a second electrode of the fourth transistor is directly coupled to the first node;

a control electrode of the fifth transistor is directly coupled to the second light-emitting timing signal terminal, and a first electrode of the fifth transistor is directly coupled to the first voltage signal terminal.

5. The pixel driving circuit according to claim 1, further comprising:

a storage sub-circuit and a data writing sub-circuit, wherein the storage sub-circuit is directly coupled to the second node and a third node, and the storage sub-circuit is configured to be charged due to action of voltages of the second node and the third node, change a voltage of the second node according to a voltage of the third node, and maintain the voltage of the second node; and the data writing sub-circuit is directly coupled to the third node, an input control signal terminal and a data signal terminal, and the data writing sub-circuit is configured to transmit a data signal received from the data signal terminal to the third node in response to an input control signal received from the input control signal terminal.

6. The pixel driving circuit according to claim 5, wherein the storage sub-circuit includes a first capacitor;

a first end of the first capacitor is directly coupled to the third node, and a second end of the first capacitor is directly coupled to the second node; and the data writing sub-circuit includes a sixth transistor; a control electrode of the sixth transistor is directly coupled to the input control signal terminal, a first electrode of the sixth transistor is directly coupled to the data signal terminal, and a second electrode of the sixth transistor is directly coupled to the third node.

7. The pixel driving circuit according to claim 5, wherein the input control signal terminal and the second light-emitting timing signal terminal are configured to transmit the same signal, and the data writing sub-circuit is further directly coupled to the scanning timing signal terminal;

the data writing sub-circuit is configured to transmit the data signal received from the data signal terminal to the third node in response to the second light-emitting timing signal and the scanning timing signal.

8. The pixel driving circuit according to claim 7, wherein the data writing sub-circuit includes a sixth transistor and a seventh transistor;

a control electrode of the sixth transistor is directly coupled to the second light-emitting timing signal terminal, a first electrode of the sixth transistor is directly coupled to a second electrode of the seventh transistor, and a second electrode of the sixth transistor is directly coupled to the third node;

a control electrode of the seventh transistor is directly coupled to the scanning timing signal terminal, and a first electrode of the seventh transistor is directly coupled to the data signal terminal.

9. The pixel driving circuit according to claim 5, further comprising:

a reference voltage sub-circuit, wherein the reference voltage sub-circuit is directly coupled to the third node, the first light-emitting timing signal terminal and a reference voltage signal terminal; and the reference voltage sub-circuit is configured to transmit a reference voltage signal received from the reference voltage signal terminal to the third node in response to the first light-emitting timing signal received from the first light-emitting timing signal terminal.

10. The pixel driving circuit according to claim 9, wherein the reference voltage sub-circuit includes an eighth transistor;

a control electrode of the eighth transistor is directly coupled to the first light-emitting timing signal terminal, a first electrode of the eighth transistor is directly coupled to the reference voltage terminal, and a second electrode of the eighth transistor is directly coupled to the third node.

11. The pixel driving circuit according to claim 1, further comprising:

a storage sub-circuit and a data writing sub-circuit, wherein the storage sub-circuit is directly coupled to the second node and a third node;

the storage sub-circuit is configured to be charged due to action of voltages of the second node and the third node, change a voltage of the second node according to a voltage of the third node, and maintain the voltage of the second node, wherein the driving sub-circuit is further configured to:

reach a self-saturation state in response to the second light-emitting timing signal and due to action of the compensation sub-circuit to generate a compensation signal according to a first voltage signal received from the first voltage signal terminal and transmit the compensation signal to the second node through the compensation sub-circuit, and generate a driving signal according to the first voltage signal in response to the second light-emitting timing signal and due to coupling action of the storage sub-circuit.

12. The pixel driving circuit according to claim 11, further comprising a light-emitting device, wherein the reset sub-circuit is further directly coupled to the light-emitting device, and the reset sub-circuit is further configured to transmit the initialization signal received from the initialization signal terminal to the light-emitting device in response to the scanning timing signal receiving from the scanning timing signal terminal, so as to reset the light-emitting device; and the light-emitting control sub-circuit is further directly coupled to the light-emitting device, and the light-emitting control sub-circuit is further configured to transmit the driving signal from the driving sub-circuit to the light-emitting device in response to the first light-emitting timing signal, so as to drive the light-emitting device to emit light.

13. The pixel driving circuit according to claim 12, wherein the reset sub-circuit includes a first transistor, a control electrode of the first transistor is directly coupled to the scanning timing signal terminal, a first electrode of the first transistor is directly coupled to the initialization signal terminal, and a second electrode of the first transistor is directly coupled to the light-emitting control sub-circuit and the light-emitting device; and the light-emitting control sub-circuit includes a second transistor, a control electrode of the second transistor is directly coupled to the first light-emitting timing signal terminal, a first electrode of the second transistor is directly coupled to the first node, and a second electrode of the second transistor is directly coupled to the second electrode of the first transistor and the light-emitting device.

14. The pixel driving circuit according to claim 1, wherein the reset sub-circuit includes a first transistor;

the light-emitting control sub-circuit includes a second transistor;

the compensation sub-circuit includes a third transistor; and the driving sub-circuit includes a fourth transistor and a fifth transistor;

the pixel driving circuit further comprises a storage sub-circuit, a data writing sub-circuit, a reference voltage sub-circuit and a light-emitting device;

the storage sub-circuit includes a first capacitor;

the data writing sub-circuit includes a sixth transistor, or includes the sixth transistor and a seventh transistor; and the reference voltage sub-circuit includes an eighth transistor, wherein a control electrode of the first transistor is directly coupled to the scanning timing signal terminal, a first electrode of the first transistor is directly coupled to the initialization signal terminal, and a second electrode of the first transistor is directly coupled to a second electrode of the second transistor and the light-emitting device;

a control electrode of the second transistor is directly coupled to the first light-emitting timing signal terminal, a first electrode of the second transistor is directly coupled to the first node, and the second electrode of the second transistor is further directly coupled to the light-emitting device;

a control electrode of the third transistor is directly coupled to the scanning timing signal terminal, a first electrode of the third transistor is directly coupled to the first node, and a second electrode of the third transistor is directly coupled to the second node;

a control electrode of the fourth transistor is directly coupled to the second node, a first electrode of the fourth transistor is directly coupled to the first voltage signal terminal, and a second electrode of the fourth transistor is directly coupled to a first electrode of the fifth transistor;

a control electrode of the fifth transistor is directly coupled to the second light-emitting timing signal terminal, and a second electrode of the fifth transistor is directly coupled to the first node; or the control electrode of the fourth transistor is directly coupled to the second node, the first electrode of the fourth transistor is directly coupled to the second electrode of the fifth transistor, and the second electrode of the fourth transistor is directly coupled to the first node;

the control electrode of the fifth transistor is directly coupled to the second light-emitting timing signal terminal, and the first electrode of the fifth transistor is directly coupled to the first voltage signal terminal;

a first end of the first capacitor is directly coupled to a third node, and a second end of the first capacitor is directly coupled to the second node;

in a case where the data writing sub-circuit includes the sixth transistor, a control electrode of the sixth transistor is directly coupled to an input control signal terminal, a first electrode of the sixth transistor is directly coupled to a data signal terminal, and a second electrode of the sixth transistor is directly coupled to the third node; or in a case where the data writing sub-circuit includes the sixth transistor and the seventh transistor, the control electrode of the sixth transistor is directly coupled to the second light-emitting timing signal terminal, and the first electrode of the sixth transistor is directly coupled to a second electrode of the seventeen transistor, and the second electrode of the sixth transistor is directly coupled to the third node; and a control electrode of the seventh transistor is directly coupled to the scanning timing signal terminal, and a first electrode of the seventh transistor is directly coupled to the data signal terminal; and a control electrode of the eighth transistor is directly coupled to the first light-emitting timing signal terminal, a first electrode of the eighth transistor is directly coupled to a reference voltage terminal, and a second electrode of the eighth transistor is directly coupled to the third node.

15. A pixel driving method applied to the pixel driving circuit according to claim 1, the pixel driving circuit further including a storage sub-circuit, a data writing sub-circuit, a reference voltage sub-circuit, and a light-emitting device;

the storage sub-circuit being directly coupled to the second node and a third node, the data writing sub-circuit being directly coupled to the third node, an input control signal terminal and a data signal terminal, the reference voltage sub-circuit being directly coupled to the third node, the first light-emitting timing signal terminal and a reference voltage signal terminal, and the reset sub-circuit and the light-emitting control sub-circuit being further directly coupled to the light-emitting device, a frame period including a reset stage, an input and compensation stage, and a light-emitting stage;

the pixel driving method comprising:

in the reset stage:

transmitting, by the reference voltage sub-circuit, a reference voltage signal received from the reference voltage signal terminal to the third node, in response to the first light-emitting timing signal received from the first light-emitting timing signal terminal;

transmitting, by the reset sub-circuit, the initialization signal received from the initialization signal terminal to the light-emitting control sub-circuit and the light-emitting device, in response to the scanning timing signal received from the scanning timing signal terminal, so as to reset the light-emitting device;

transmitting, by the light-emitting control sub-circuit, the initialization signal to the first node, in response to the first light-emitting timing signal received from the first light-emitting timing signal terminal;

transmitting, by the compensation sub-circuit, the initialization signal from the first node to the second node, under the control of the scanning timing signal, so as to reset the voltage of the second node; and opening, by the driving sub-circuit, the conductive path from the first voltage signal terminal to the initialization signal terminal, in response to the second light-emitting timing signal received from the second light-emitting timing signal terminal.

16. The pixel driving method according to claim 15, further comprising:

in the input and compensation stage, transmitting, by the reset sub-circuit, the initialization signal received from the initialization signal terminal to the light-emitting device, in response to the scanning timing signal received from the scanning timing signal terminal, so as to continuously reset the light-emitting device;

transmitting, by the data writing sub-circuit, a data signal received from the data signal terminal to the third node, in response to an input control signal received from the input control signal terminal;

reaching, by the driving sub-circuit, the self-saturation state, in response to the second light-emitting timing signal and due to action of the compensation sub-circuit to generate a compensation signal according to a first voltage signal received from the first voltage signal terminal, and transmitting, by the driving sub-circuit, the compensation signal to the second node through the compensation sub-circuit; and charging the storage sub-circuit due to action of voltages of the second node and the third node; and in the light-emitting stage, transmitting, by the reset sub-circuit, the reference voltage signal received from the reference voltage signal terminal to the third node, in response to the first light-emitting timing signal received from the first light-emitting timing signal terminal;

changing, by the storage sub-circuit, a voltage of the second node, due to action of a voltage of the third node; maintaining, by the storage sub-circuit, the voltage of the second node;

generating, by the driving sub-circuit, a driving signal, in response to the second light-emitting timing signal and due to coupling action of the storage sub-circuit, and transmitting, by the driving sub-circuit, the driving signal to the light-emitting control sub-circuit; and transmitting, by the light-emitting control sub-circuit, the driving signal from the driving sub-circuit to the light-emitting device, in response to the first light-emitting timing signal, so as to drive the light-emitting device to emit light.

17. The pixel driving method according to claim 16, wherein the data writing sub-circuit includes a sixth transistor, a control electrode of the sixth transistor is directly coupled to the input control signal terminal, a first electrode of the sixth transistor is directly coupled to the data signal terminal, and a second electrode of the sixth transistor is directly coupled to the third node; the pixel driving method further comprises:

in the input and compensation stage, turning on the sixth transistor, under control of the input control signal, so as to transmit the data signal to the third node; or the input control signal terminal and the second light-emitting timing signal terminal are configured to transmit a same signal, the data writing sub-circuit is further directly coupled to the scanning timing signal terminal, the data writing sub-circuit includes the sixth transistor and a seventh transistor, the control electrode of the sixth transistor is directly coupled to the second light-emitting timing signal terminal, the first electrode of the sixth transistor is directly coupled to a second electrode of the seventh transistor, the second electrode of the sixth transistor is directly coupled to the third node, a control electrode of the seventh transistor is directly coupled to the scanning timing signal terminal, and a first electrode of the seventh transistor is directly coupled to the data signal terminal;

the pixel driving method further comprises:

in the input and compensation stage, turning on the seventh transistor, under control of the scanning timing signal, so as to transmit the data signal to the first electrode of the sixth transistor; and turning on the sixth transistor, under control of the first light-emitting timing signal, so as to transmit the data signal to the third node.

18. A display panel, comprising pixel driving circuits according to claim 1.

19. The display panel according to claim 18, wherein the display panel comprises a plurality of sub-pixels; a sub-pixel includes a pixel driving circuit, and the plurality of sub-pixels are arranged in an array with a plurality of rows and a plurality of columns;

the display panel further comprises a plurality of scanning timing signal lines and a plurality of light-emitting timing signal lines that extend in a row direction;

scanning timing signal terminals of pixel driving circuits included in an nth row of sub-pixels are coupled to an nth scanning timing signal line; and first light-emitting timing signal terminals of the pixel driving circuits included in the nth row of sub-pixels are coupled to an nth light-emitting timing signal line; and other than a first row of sub-pixels, second light-emitting timing signal terminals of the pixel driving circuits included in the nth row of sub-pixels are coupled to an (n−1)th light-emitting timing signal line.

20. A display apparatus, comprising the display panel according to claim 18.

* * * * *